US012428827B2

(12) United States Patent
Le et al.

(10) Patent No.: US 12,428,827 B2
(45) Date of Patent: Sep. 30, 2025

(54) OMNI CONFIGURED FLAPPER SYSTEMS FOR VARIOUS FLUSH VALVE SIZES AND METHODS OF RETROFIT

(71) Applicant: FLUIDMASTER, INC., San Juan Capistrano, CA (US)

(72) Inventors: Tuan Le, Fountain Valley, CA (US); Joseph Han, Irvine, CA (US); Leland Wong, Costa Mesa, CA (US); Daniel McAuley, Irvine, CA (US); Jack Nguyen, San Clemente, CA (US); Daniel McFarland, San Juan Capistrano, CA (US); Krishna Arkalgud, Rancho Santa Margarita, CA (US); Ben Ton, Santa Ana, CA (US); Dan Lohde, San Juan Capistrano, CA (US); Mike Robbins, Eastvale, CA (US); William Martin, San Clemente, CA (US)

(73) Assignee: FLUIDMASTER, INC., San Juan Capistrano, CA (US)

( * ) Notice: Subject to any disclaimer, the term of this patent is extended or adjusted under 35 U.S.C. 154(b) by 151 days.

(21) Appl. No.: 17/988,397

(22) Filed: Nov. 16, 2022

(65) Prior Publication Data

US 2023/0160191 A1 May 25, 2023

Related U.S. Application Data

(60) Provisional application No. 63/282,104, filed on Nov. 22, 2021.

(51) Int. Cl.
*E03D 1/35* (2006.01)

(52) U.S. Cl.
CPC ..... *E03D 1/35* (2013.01)

(58) Field of Classification Search
CPC ..... E03D 1/35; E03D 1/306
(Continued)

(56) References Cited

U.S. PATENT DOCUMENTS 3,369,259 A * 2/1968 Harold ..... E03D 1/306 4/393
4,419,773 A * 12/1983 Sullivan ..... E03D 1/34 4/395

(Continued)

FOREIGN PATENT DOCUMENTS

CA 2825460 A1 * 2/2014 ..... E03D 1/306
CA 3107719 A1 * 8/2021 ..... E03D 1/35

(Continued)

OTHER PUBLICATIONS

International Search Report and Written Opinion for related International PCT Application No. PCT/US2022/050103, dated Mar. 22, 2023; 12 pages.

*Primary Examiner* — Lori L Baker
(74) *Attorney, Agent, or Firm* — Greenberg Traurig, LLP

(57) ABSTRACT

The disclosure is directed to a flapper system and a flapper system kit that is compatible with both 2" and 3" flush valve seats. In some embodiments, the flapper system is configured to enable a user to select either a 2" or 3" flush valve seal for the flapper system. In some embodiments, the flapper system includes a pivot that enables sealing of a flat flush valve seat or an angled flush valve seat. In some embodiments, the flapper system includes one or more adjustable window assemblies that control a fluid flowrate within an internal portion of the flapper system to control buoyancy. In some embodiments, the flapper system includes an adaptor that converts a 2" valve into a 3" valve.

17 Claims, 46 Drawing Sheets

(58) Field of Classification Search
USPC ..... 4/393, 392
See application file for complete search history.

(56) References Cited

U.S. PATENT DOCUMENTS

| | | | | |
|---|---|---|---|---|
| 4,841,579 | A * | 6/1989 | Antunez | E03D 1/35 4/395 |
| 5,182,819 | A * | 2/1993 | Shaw | E03D 1/306 4/395 |
| 5,390,375 | A * | 2/1995 | Fernstrum, Jr. | E03D 1/142 4/393 |
| 6,401,268 | B2 * | 6/2002 | Higgins | E03D 1/35 4/393 |
| 6,675,398 | B1 * | 1/2004 | Antunez | E03D 1/36 137/391 |
| 7,216,373 | B2 * | 5/2007 | Huang | E03D 1/35 4/393 |
| 7,222,375 | B2 * | 5/2007 | Chen | E03D 1/142 4/404 |
| 8,079,095 | B2 * | 12/2011 | Jensen | E03D 1/35 4/399 |
| 8,087,106 | B1 * | 1/2012 | Mitchell | E03D 5/094 4/393 |
| 8,196,898 | B1 * | 6/2012 | Huang | E03D 1/306 251/298 |
| 8,230,532 | B2 * | 7/2012 | Htay | E03D 1/306 4/392 |
| 9,915,059 | B2 * | 3/2018 | Grover | E03D 9/04 |
| 2010/0212080 | A1 * | 8/2010 | Huang | E03D 1/142 4/393 |
| 2013/0269093 | A1 * | 10/2013 | Vlach | E03D 1/306 4/393 |
| 2014/0059756 | A1 * | 3/2014 | Guthrie | E03D 1/306 4/393 |
| 2014/0325749 | A1 * | 11/2014 | Huang | E03D 1/306 4/393 |

FOREIGN PATENT DOCUMENTS

| | | | | |
|---|---|---|---|---|
| CN | 201785835 | U | 4/2011 | |
| CN | 203669058 | U | 6/2014 | |
| CN | 211113933 | U | 7/2020 | |
| JP | 2011-074686 | A | 4/2011 | |
| KR | 10-2003-0004457 | A | 1/2003 | |
| WO | WO-2009073143 | A1 * | 6/2009 | E03D 1/306 |

* cited by examiner

OMNI CONFIGURED FLAPPER SYSTEMS FOR VARIOUS FLUSH VALVE SIZES AND METHODS OF RETROFIT

CROSS-REFERENCE TO RELATED APPLICATION

This application claims the benefit of and priority to U.S. Provisional Application No. 63/282,104, filed Nov. 22, 2021, which is incorporated herein by reference in its entirety.

BACKGROUND

For the do-it-yourself (DIY) consumer, selecting the correct replacement flapper for a flush valve can be a daunting task. Different manufacturers create different flush valves for cisterns based on local regulations, manufacturer preferences, or customer requirements. There may be differences between flush valve sizes within a single home or office building. For instance, some flush valves may have a 2" diameter seat, while other flush valve seat diameters may be 3". Currently, a consumer must know the correct flapper size to purchase before heading to a store. Additionally, the upper surfaces of seats vary and may be angled or horizontal. However, the consumer may not have realized that such knowledge was necessary, nor how to obtain it, when standing in front of a huge selection of flapper choices.

Therefore, there is a need in the art for a system and/or method that allows for a single flush valve flapper system that fits multiple flush valve sizes.

SUMMARY

In some embodiments, the disclosure is directed to a flapper system and/or a flapper kit (collectively referred to herein as the flapper system, where a flapper kit can comprise any combination of elements described herein). In some embodiments, the flapper system comprises one or more of a flapper main body, an upper buoyancy dome, a first lower buoyancy dome, a second lower buoyancy dome and one or more mounting arms. In some embodiments, the upper buoyancy dome comprises a protrusion rod. In some embodiments, the flapper main body comprises an open portion configured to enable the protrusion rod to pass therethrough. In some embodiments, the open portion is located along a flapper main body central axis.

In some embodiments, the first lower buoyancy dome is configured to couple to the upper buoyancy dome via the protrusion rod. In some embodiments, the flapper main body is configured to be coupled between the upper buoyancy dome and the first lower buoyancy dome when the flapper system is assembled.

In some embodiments, the flapper main body comprises a main body window configured to enable water and/or air to pass therethrough. In some embodiments, the first lower buoyancy dome comprises a lower dome window configured to enable water and/or air to pass therethrough. In some embodiments, the main body window and the lower dome window cooperate with each other to adjust a water and/or air flowrate through both windows to form an adjustable window. In some embodiments, the upper buoyancy dome comprises a movement (e.g., rotation) engagement portion (top level adjustment) configured to enable a user to move (e.g., rotate) the upper buoyancy dome relative to the flapper main body. In some embodiments, a movement (e.g., rotation) of the upper buoyancy dome relative to the flapper main body causes a relative movement (e.g., rotation) of at least one of the first lower buoyancy dome and second lower buoyancy dome to the flapper main body. In some embodiments, the water and/or air flowrate adjustment is a result of the relative movement (e.g., rotation). In some embodiments, the movement engagement portion comprises an indicator configured to convey a window open position and/or actuation result (e.g., percentage, time).

In some embodiments, the flapper main body is configured to be coupled and/or secured between the upper buoyancy dome and the first lower buoyancy dome when the flapper system is assembled. In some embodiments, the flapper main body comprises a first groove and a second groove. In some embodiments, the first groove is configured to secure a first (e.g., 2") flush valve seal to the flapper main body. In some embodiments, the second groove is configured to secure a second (e.g., 3") flush valve seal to the flapper main body. In some embodiments, the first flush valve seal is a different size than the second flush valve seal. In some embodiments, a flush valve seal comprises a seal configured to prevent a flow of water through a cistern flush valve out of a cistern tank.

In some embodiments, each of the one or more mounting arms comprise a first fulcrum and a second fulcrum. In some embodiments, a fulcrum is configured to engage with a mounting ear on a flush valve assembly which serves as a pivot point for lifting the flapper system (e.g., with a chain) to enable the cistern to empty its fluid volume. In some embodiments, the first fulcrum is configured to align a first flush valve seal with a 2 inch flush valve seat to prevent a flow of water out of a cistern. In some embodiments, the second fulcrum is configured to align a second flush valve seal with a 3 inch flush valve seat to prevent the flow of water out of a cistern. In some embodiments, the one or more mounting arms are pivotally mounted to the flapper main body on a pivot. In some embodiments, a pivot point is integral to one or more of the upper buoyancy dome, the flapper main body, or one or more lower buoyancy domes. In some embodiments, the pivot is configured to enable the flapper system to seal either a flat valve or an angled flush valve seat.

In some embodiments, the flapper system comprises a second lower buoyancy dome. In some embodiments, the second lower buoyancy dome is configured to increase a buoyancy of the flapper system greater than the first lower buoyancy dome. In some embodiments, the second lower buoyancy dome is configured to couple to at least one of the upper buoyancy dome, the flapper main body, and the first lower buoyancy dome. In some embodiments, the coupling increases the buoyancy. In some embodiments, the upper buoyancy dome is configured to be mounted to the flapper main body. In some embodiments, a rotation of the upper buoyancy dome adjusts the flowrate of water through both windows. In some embodiments, the flapper system comprises a plurality of windows that allow fluid to enter the first and/or second lower buoyancy dome.

In some embodiments, the upper buoyancy dome comprises an adjustable upper dome including one or more depressed sections and/or one or more raised sections. In some embodiments, the one or more raised sections are configured to increase the amount of air within the adjustable upper dome. In some embodiments, the one or more depressed sections are configured to decrease an amount of air underneath the adjustable upper dome.

In some embodiments, the adjustable upper dome is configured to be rotated such that the one or more raised sections are distal from the one or more fulcrums, such that the one or more raised sections are higher than the one or more depressed sections when the flapper system is rotated about the one or more fulcrum mounts (e.g., when lifted by the chain). In some embodiments, the one or more raised sections being higher than the one or more depressed sections is configured to enable the raised section to be above the one or more air bleeds resulting in the trapping of air in the one or more raised sections by water below the one or more raised sections. In some embodiments, the one or more raised sections being higher than the one or more depressed sections and/or the one or more air bleeds is configured to cause the flapper system to remain raised a longer time during a flushing operation than when the one or more depressed sections are higher than the one or more raised sections.

In some embodiments, the adjustable upper dome is configured to be rotated such that the one or more depressed sections are distal from the one or more fulcrums, such that the one or more depressed sections are higher than the one or more raised sections when the flapper system is rotated about the one or more fulcrum mounts (e.g., when lifted by the chain). In some embodiments, the one or more depressed sections being higher than the one or more raised sections is configured to cause fluid to become trapped in the one or more raised portions. In some embodiments, the fluid becomes trapped due to the one or more raised portions being below one or more air bleeds which allows air to escape the one or more raised sections which results in the one or more raised sections flooding with fluid when the flapper system is raised during a flushing operation. In some embodiments, the one or more depressed sections being higher than the one or more raised sections is configured to cause the flapper system to remain raised for a shorter time during a flushing operation than when the one or more depressed sections are lower than the one or more raised sections during a flushing operation.

In some embodiments, the adjustable upper dome is configured to be adjustable such that at least a portion of the depressed section and at least a portion of the raised section is distal from the one or more fulcrum mounts. In some embodiments, this enables selective adjustment for the timing of when the flapper system is lowered.

In some embodiments, the flapper system comprises one or more of a flapper main body, a first fulcrum arm, and a second fulcrum arm. In some embodiments, the first fulcrum arm is configured to align the flapper main body with a 2 inch flush valve seat when connected to a 2 inch flush valve. In some embodiments, the second fulcrum arm is configured to align the flapper main body with a 3 inch flush valve seat when connected to a 3 inch flush valve. In some embodiments, the first fulcrum arm is configured to separably couple to the flapper main body (e.g., via a snap-fit fastener). In some embodiments, the second fulcrum arm is configured to separably couple to the first fulcrum arm (e.g., via a snap-fit fastener).

In some embodiments, the flapper main body comprises an upper buoyancy dome. In some embodiments, the upper buoyancy dome comprises a link fastener. In some embodiments, the link fastener is located at one or more of the front, rear, center, left, and right sides of the upper buoyancy dome.

DRAWING DESCRIPTION

DETAILED DESCRIPTION

Figure 1:
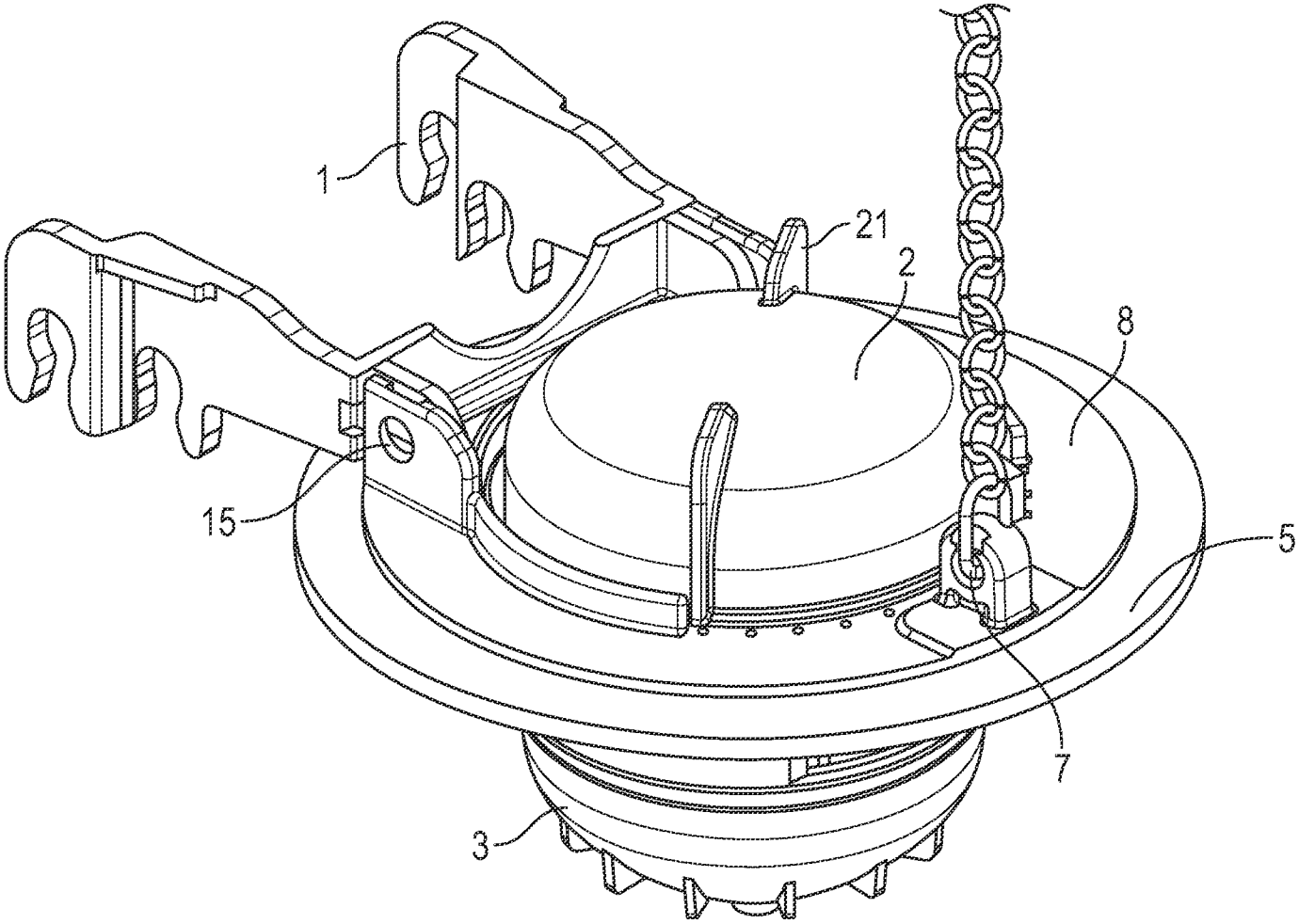
FIG. 1 illustrates a top isometric view of the flapper system according to some embodiments.

FIG. 1 illustrates a top isometric view of the flapper system (also referred to herein as the "system") according to some embodiments. In some embodiments, the flapper system is configured to provide unique flappers that can be installed easily into different flush valve applications. In some embodiments, the flapper system is configured to fit different flush valves sizes of using one kit. In some embodiments, the flapper system is configured to work with 2 inch (2") and 3 inch (3") flush valves where the valve seat is an angle seat or flat seat. In some embodiments, the flapper system includes upper dome adjuster 21 that is configured to be manipulated with one hand. In some embodiments, the flapper system is configured to minimize confusion during selection process when dealing with too many flappers options in the market. In some embodiments, the flapper system is simple to install. In some embodiments, the flapper system is configured to provide a similar look to the original flappers while including additional adjustment features. In some embodiments, the flapper system provides the benefit of being able to reduce a number of SKUs to be carried for different applications.

In some embodiments, the system includes a flapper that includes one or more of six main components: one or more mounting arms 1, one or more upper buoyancy domes 2, a second lower buoyancy dome 3, a first lower buoyancy dome 4, a flapper main body 8, a second flush valve seal 5, a first flush valve seal 6, and one or more chains 7.

Figure 2:
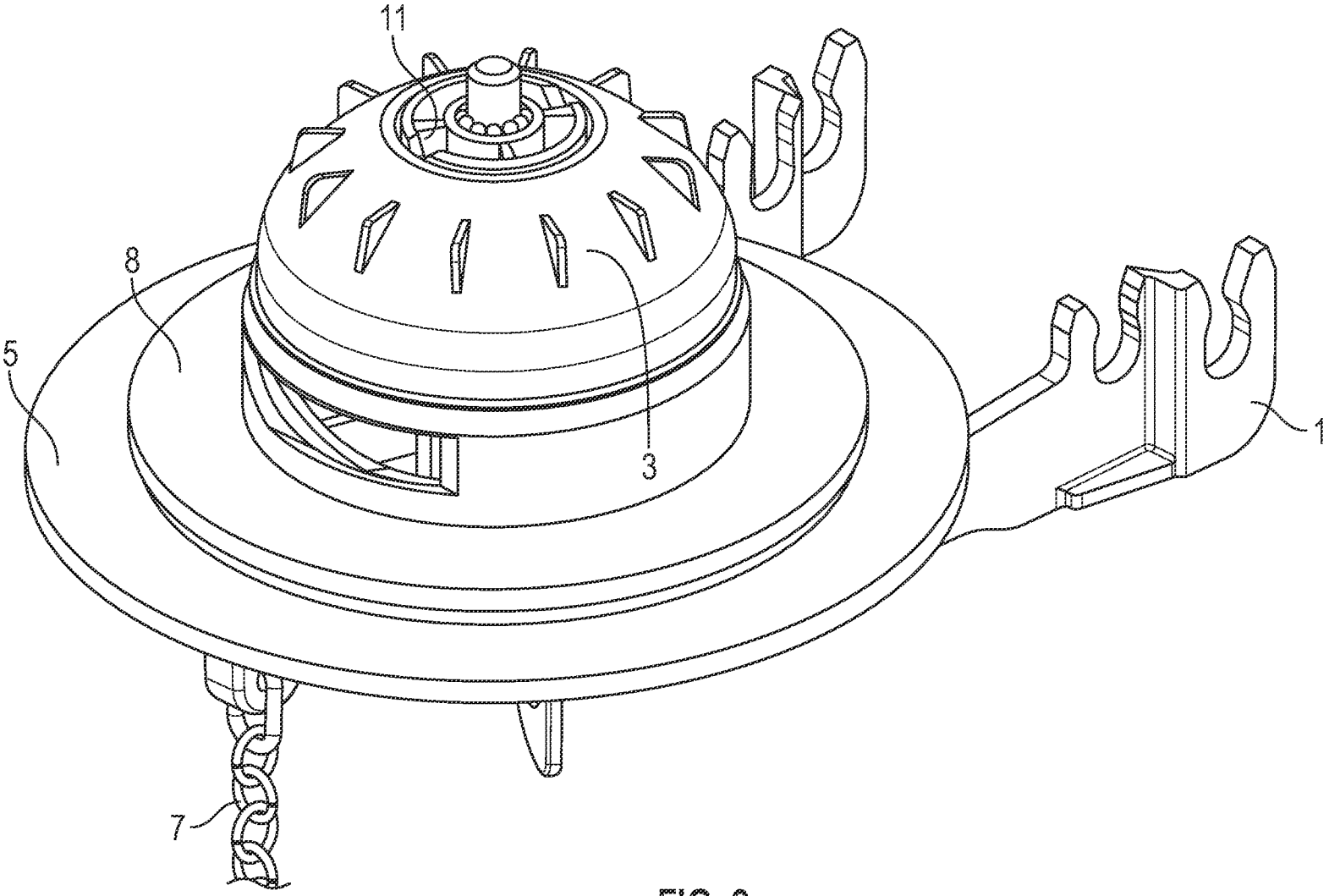
FIG. 2 shows a bottom isometric view of the flapper system according to some embodiments.
Figure 3:
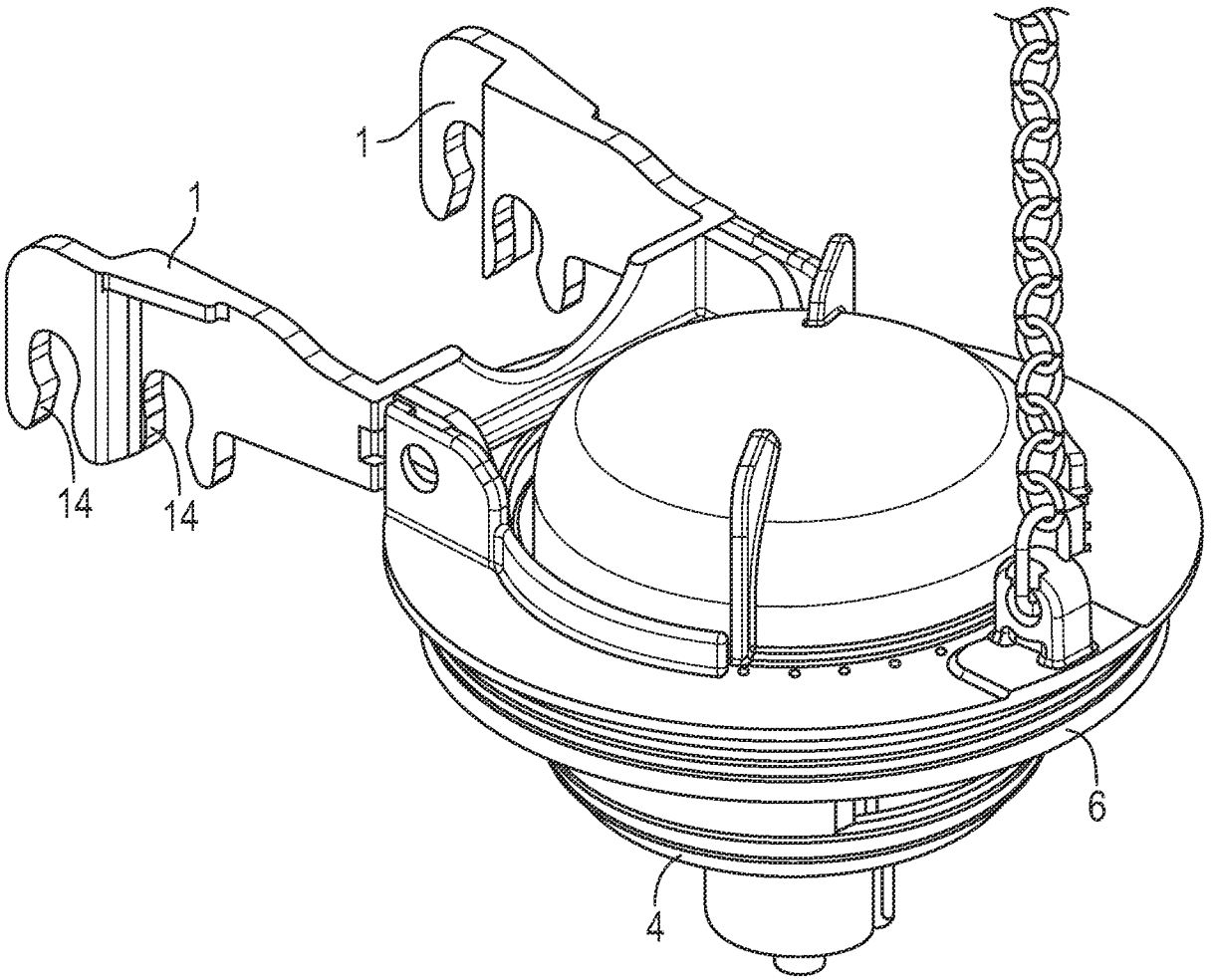
FIG. 3 depicts a top isometric view of the flapper system according to some embodiments.

FIG. 2 shows a bottom isometric view of the flapper system according to some embodiments. FIG. 3 depicts a top isometric view of the flapper system according to some embodiments. In some embodiments, the one or more mounting arms 1 are pivotally mounted to the flapper main body 8 about a pivot 15. In some embodiments, the one or more mounting arms 1 are configured to allow relative movement to allow the flapper main body 8 to self-adjust to different sealing surfaces on different flush valve seats (e.g., a flat seat and an angled seat).

In some embodiments, the upper buoyancy dome 2 is configured to be mounted and sealed against the inside wall of the flapper main body 8. In some embodiments, the center section of the upper buoyancy dome 2 comprises a protrusion rod 9 (see FIG. 6) comprising a key-lock feature(s) 10 that is configured to extend downward to engage and/or align with the lower small buoyancy dome 4 so that the two domes can be rotated or otherwise moved together in alignment. In some embodiments, the protrusion rod 9 is configured to lock the upper buoyancy dome 2 and the lower small buoyancy dome 3 and/or large buoyancy 4 in a coupled state.

Figure 4:
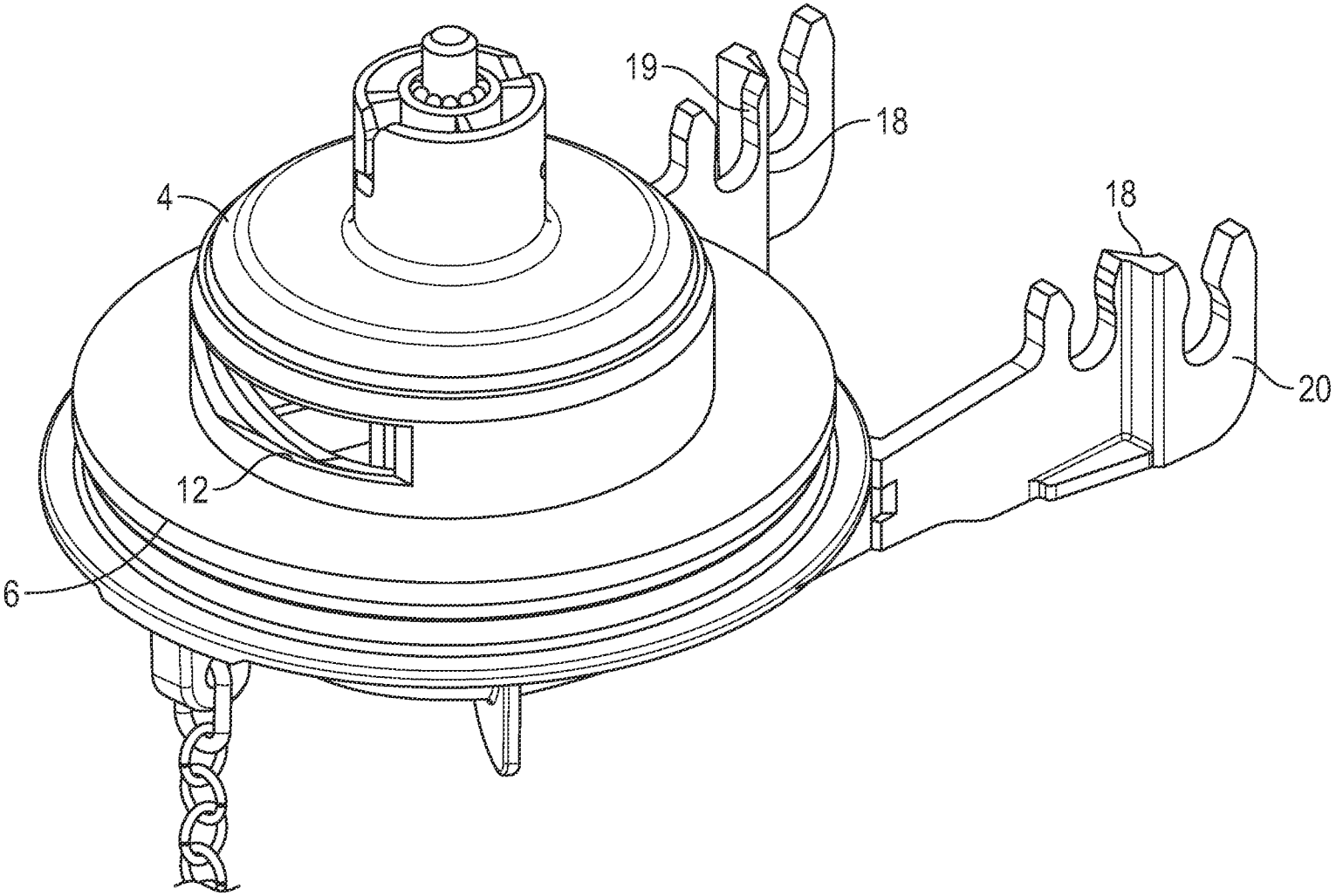
FIG. 4 shows a bottom isometric view of the flapper system according to some embodiments.
Figure 5:
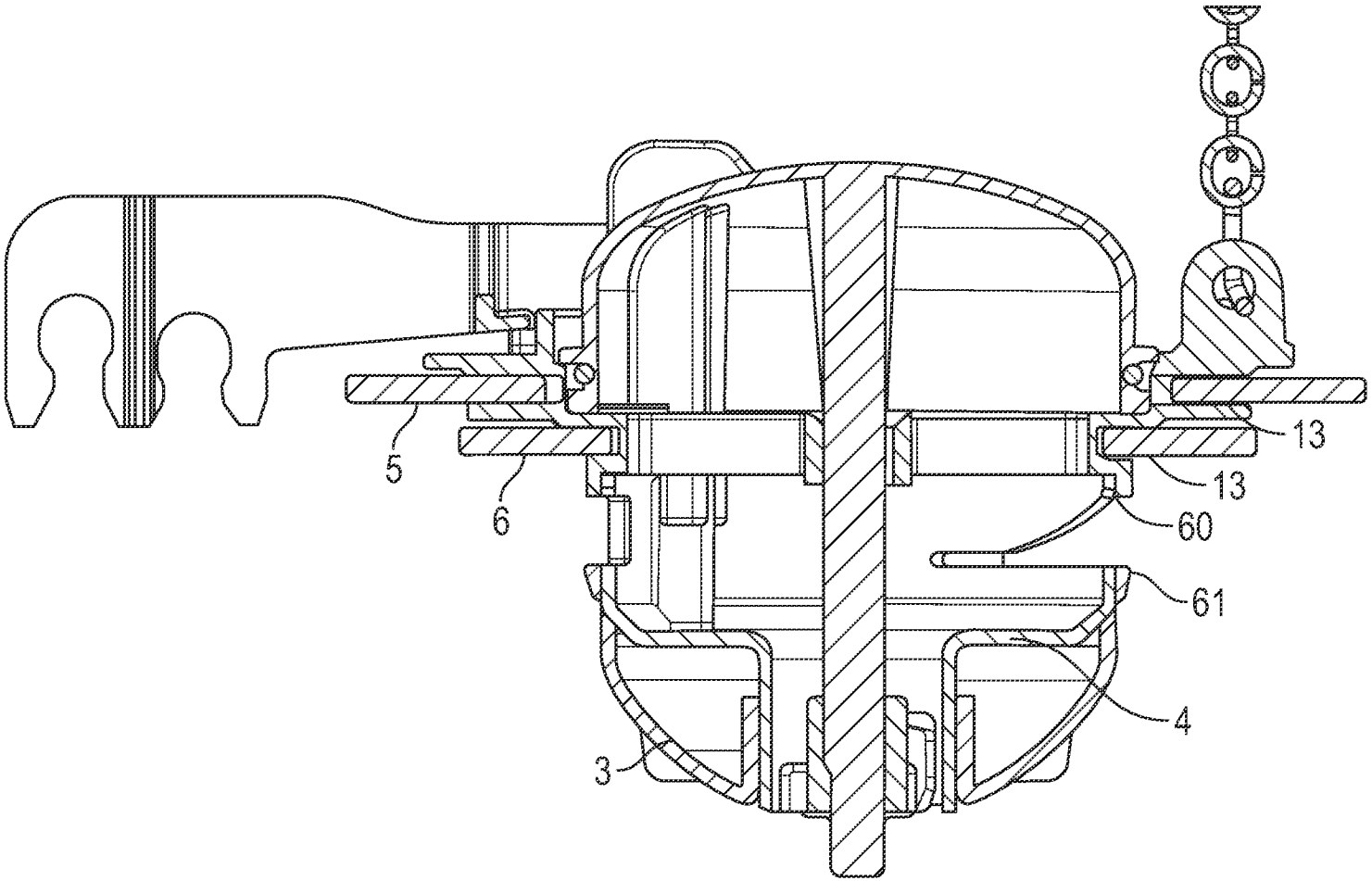
FIG. 5 shows a side sectional view of the flapper system according to some embodiments.

FIG. 4 shows a bottom isometric view of the flapper system according to some embodiments. FIG. 5 shows a side sectional view of the flapper system according to some embodiments. In some embodiments, at least a portion of an upper section of the lower large buoyance dome 3 and/or the lower small buoyancy dome 4 has one or more lower dome windows 60 that are correspondingly matched with one or more main body windows 61 on the lower section of the flapper main body 8 that form an adjustable window 12 which provides an air bleed and/or water entrance path. The term window as used herein shall include any aperture of any shape, orientation or size.

In some embodiments, the flapper main body 8 is sandwiched between the upper buoyancy dome 2 and the first lower buoyancy dome 4 and is configured to be relatively rotated or otherwise moved against or adjacent these two dome assemblies to provide the adjustment for one or more air bleeding and water entrance paths via the one or more adjustable windows 12. In some embodiments, an adjustable window 12 is configured to control the shut off time (i.e., floating time before lowering to seal the flush valve) of the flapper system. In some embodiments, one or more of the first lower buoyancy dome and the second lower buoyancy dome comprise a water bleed path 11 at a bottom portion configured to enable water to drain from a portion of the flapper system. In some embodiments, the water bleed path 11 is configured to be adjusted by rotating the upper buoyancy dome 2 which may be in the form of an adjustable upper dome 21.

Figure 6:
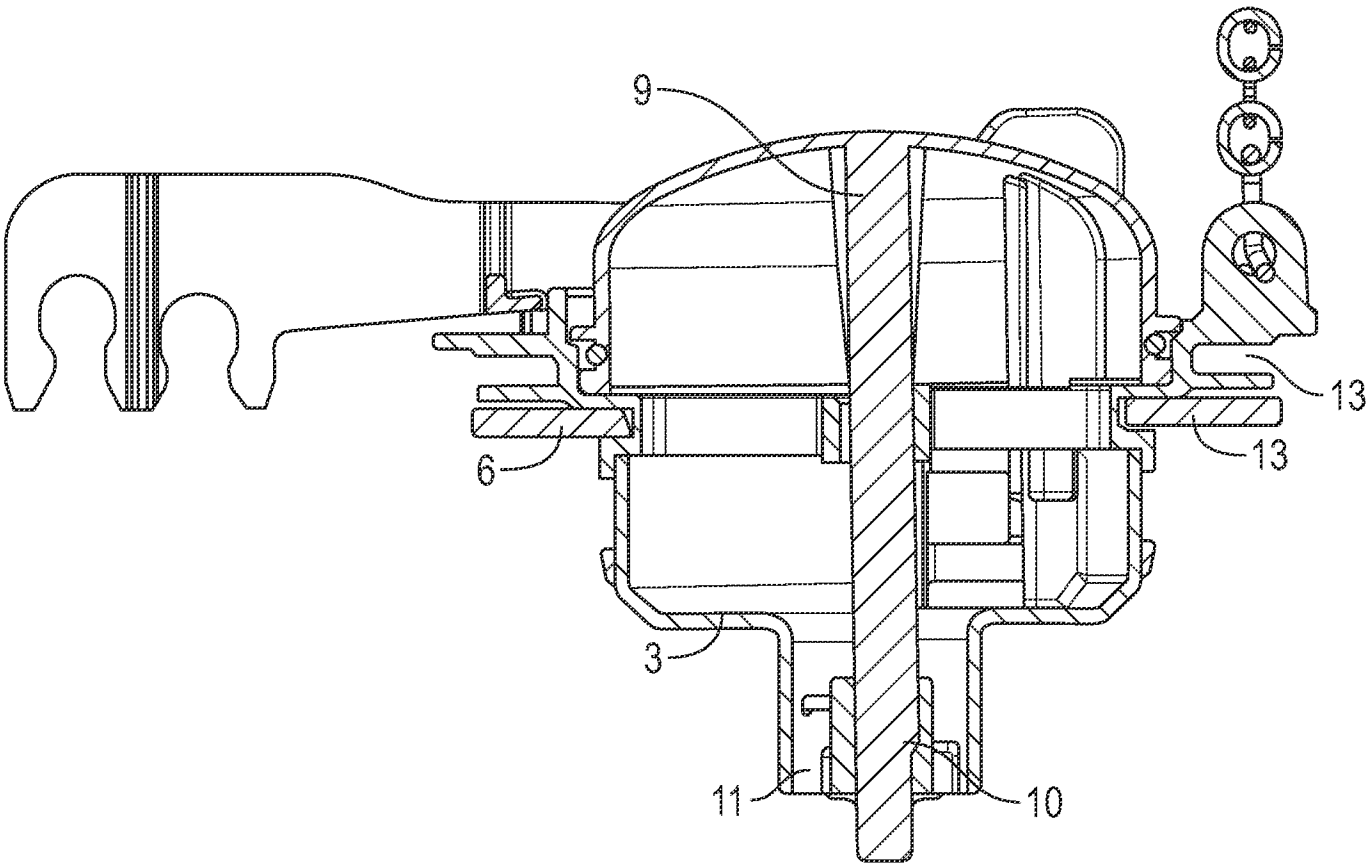
FIG. 6 depicts a side sectional view of the flapper system according to some embodiments.

FIG. 6 depicts a side sectional view of the flapper system with the second (large) flush valve seal 5 and second lower buoyancy dome 3 removed according to some embodiments. In some embodiments, the flapper main body 8 has at least two mounting grooves 13. In some embodiments, at least two mounting grooves 13 are each configured for one of the two different seals: first (large) flush valve seal 5 and second (smaller) flush valve seal 6. In some embodiments, the first flush valve seal 5 is configured to seal against a 3" flush seat and the second flush valve seal 6 is configured to seal against a 2" flush seat.

In some embodiments, each of the one or more mounting arms 1 include one or more fulcrums 14 distal from the flapper main body 8. In some embodiments, the one or more mounting arms 1 include two extended legs with each leg providing two staggered fulcrum mounts 18. In some embodiments, a first fulcrum mount 19 pair for a first size flush valve is separated by a shorter distance than a second fulcrum mount 20 pair for a second flush valve. In some embodiments, the first mounting fulcrum 19 pair are configured to mount the flapper to a first (e.g., 2") flush valve seat and the second mounting fulcrum 20 pair are configured to mount to a second (e.g., 3") flush valve seat which is a different size than the first flush valve seat.

Figure 7:
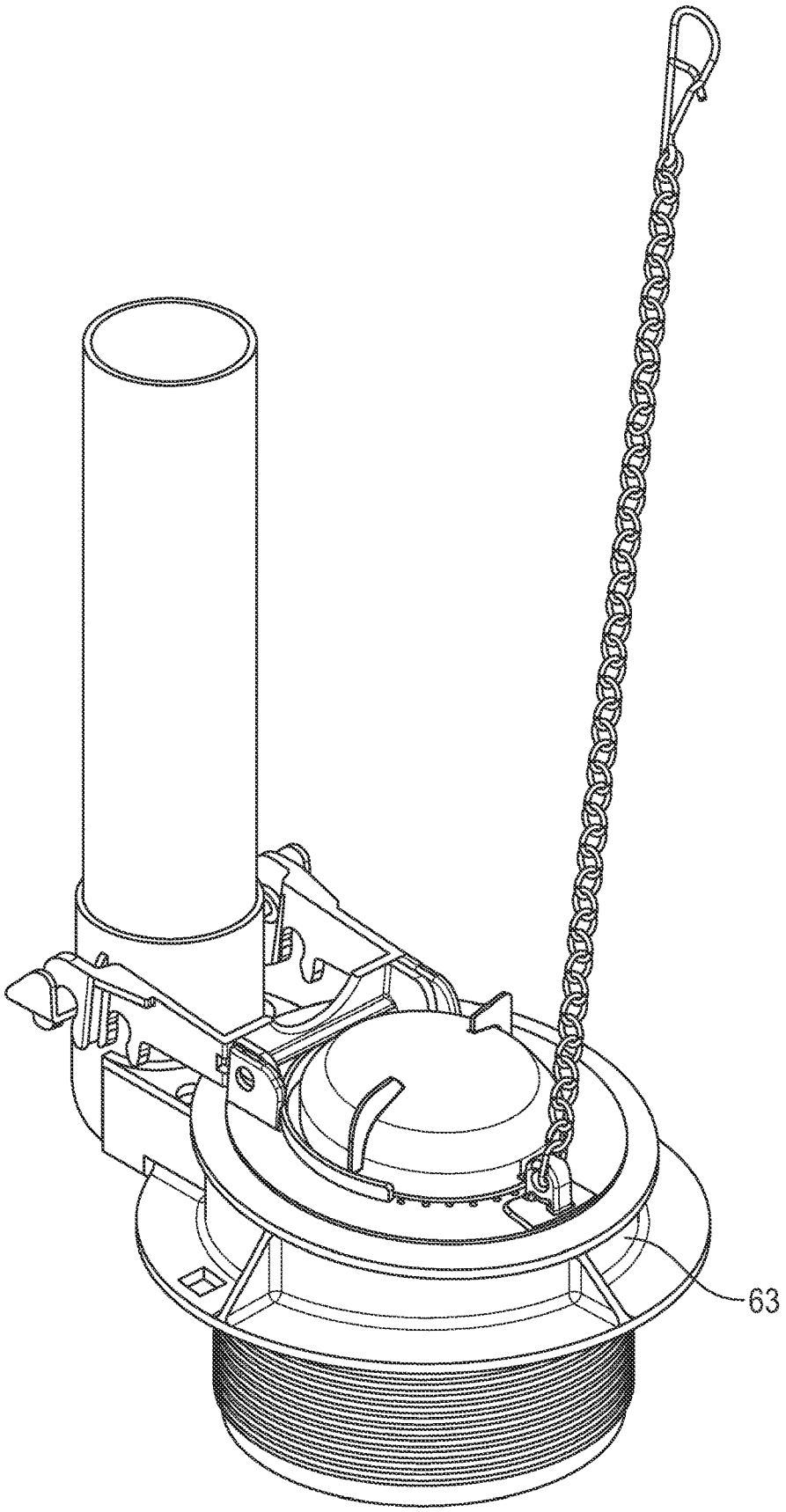
FIG. 7 shows the flapper system installed on a 3" flush valve seat according to some embodiments.
Figure 8:
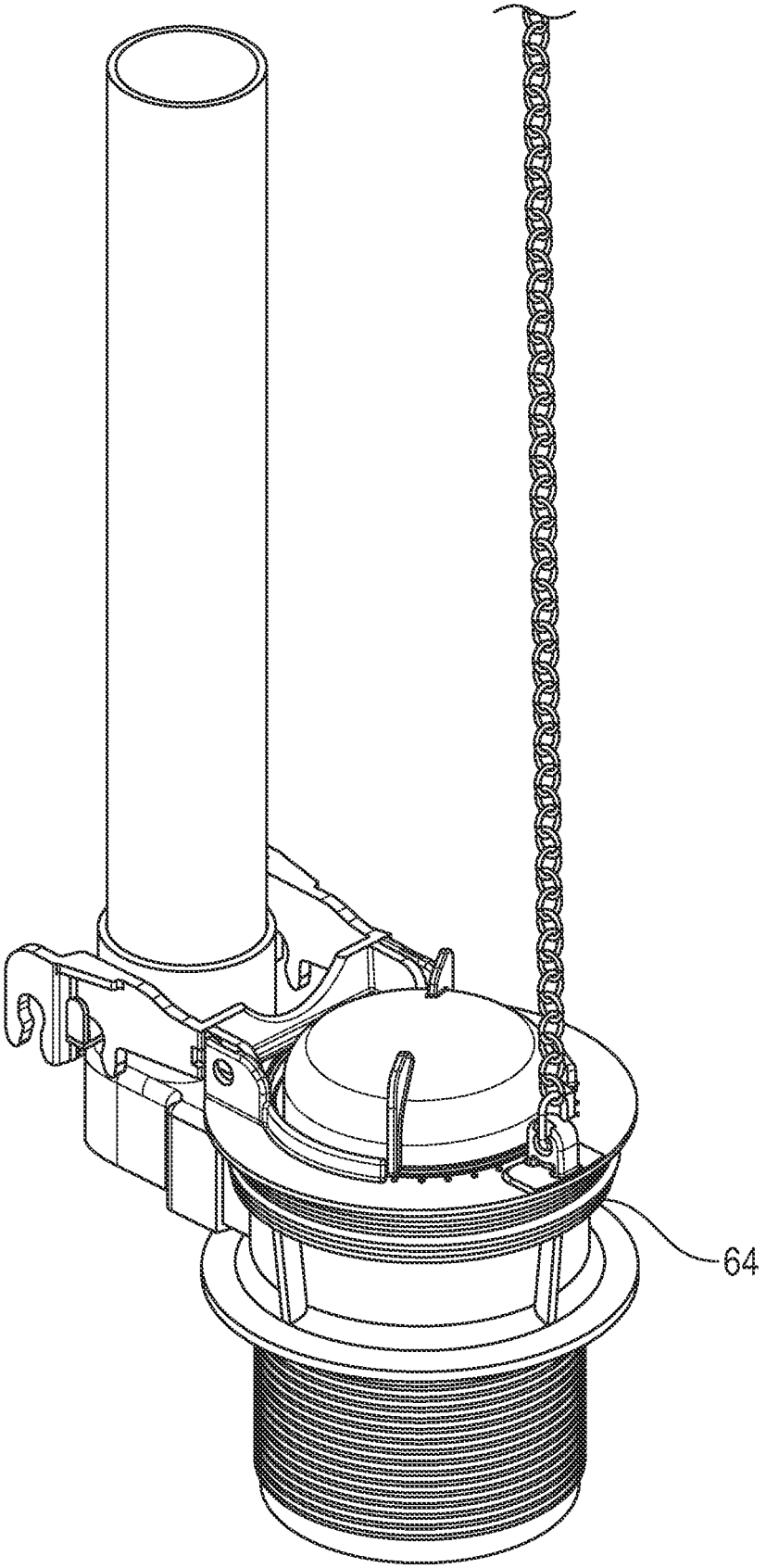
FIG. 8 illustrates the flapper system installed on a 2" flush valve seat according to some embodiments.
Figure 9:
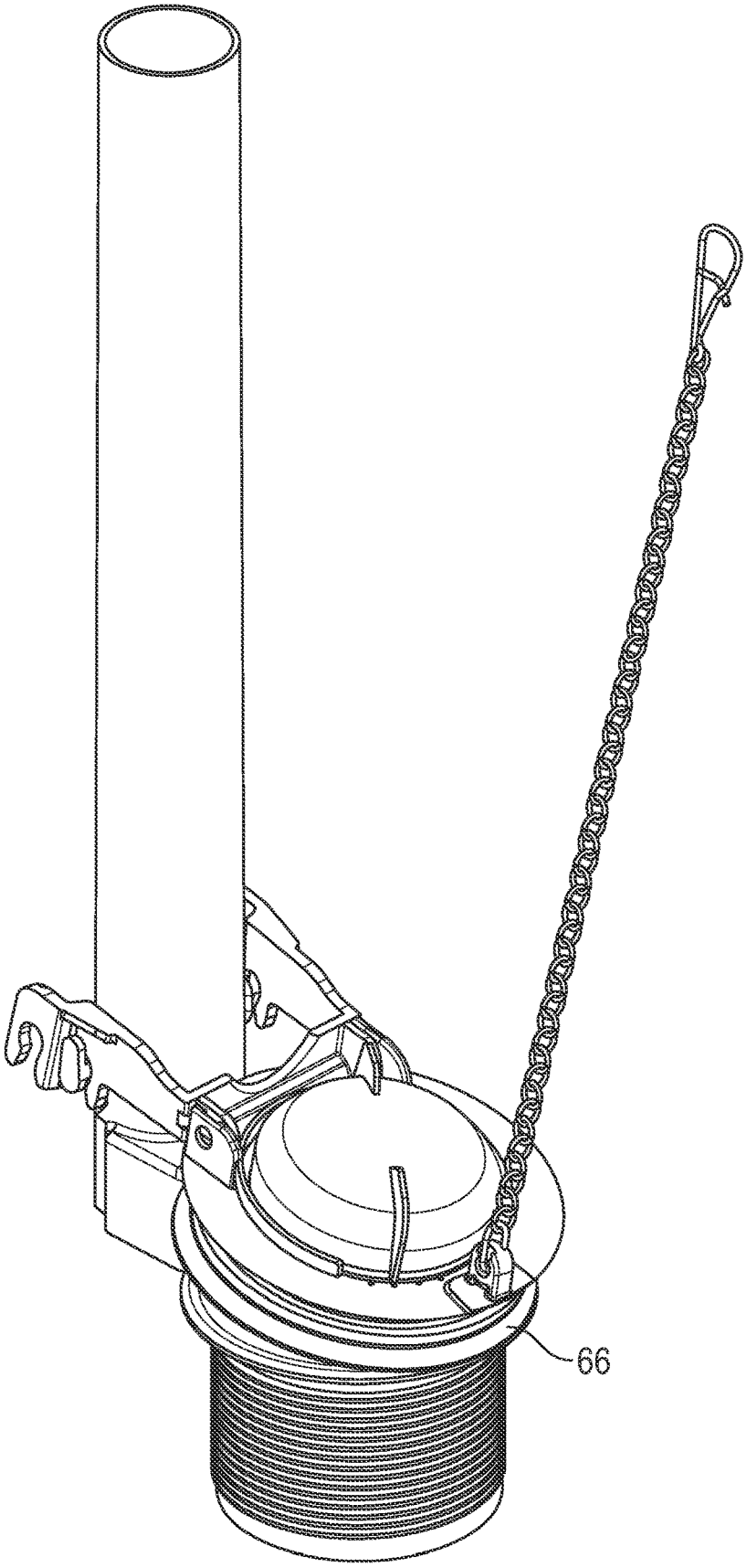
FIG. 9 depicts the flapper system installed on a 2" angled flush valve seat according to some embodiments.

FIG. 7 shows the flapper system installed on a 3" flush valve seat 63 according to some embodiments. FIG. 8 illustrates the flapper system installed on a 2" flush valve seat 64 according to some embodiments. FIG. 9 depicts the flapper system installed on a 2" angled flush valve seat 65 according to some embodiments.

Figure 10:
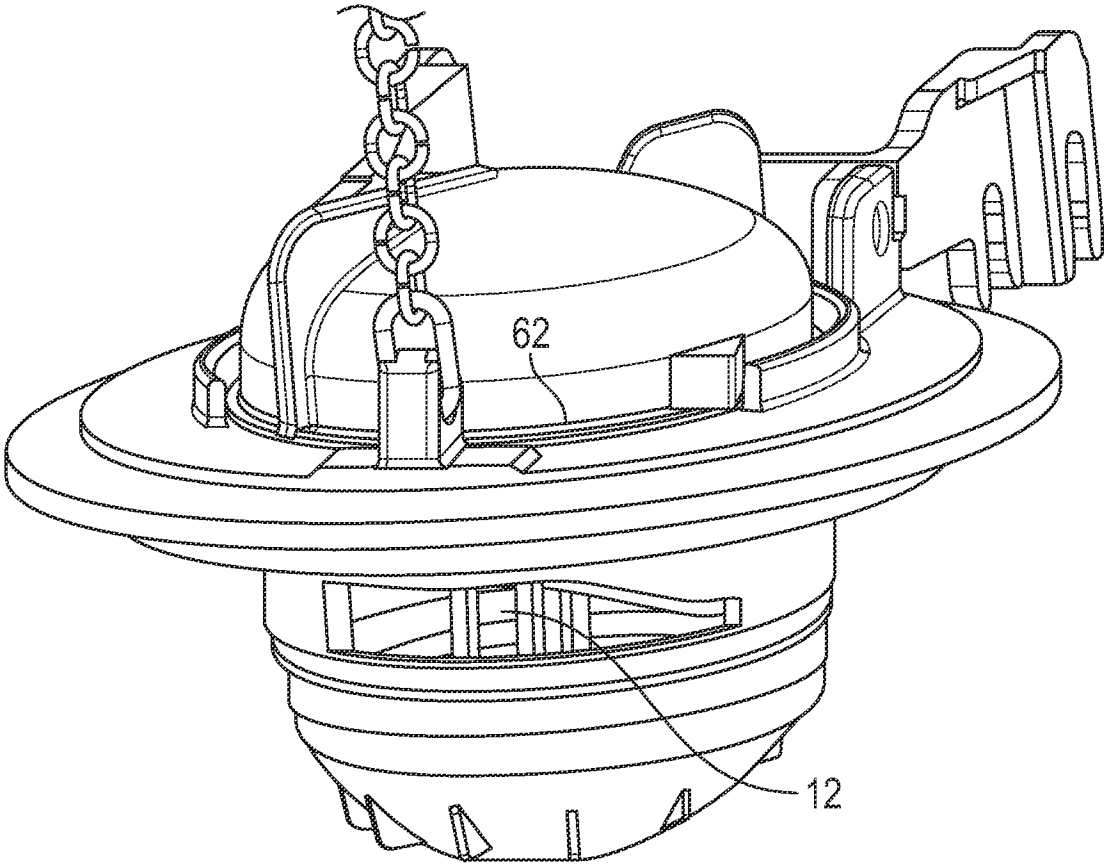
FIG. 10 illustrates a front fully opened adjustable window for minimum buoyancy according to some embodiments.
Figure 11:
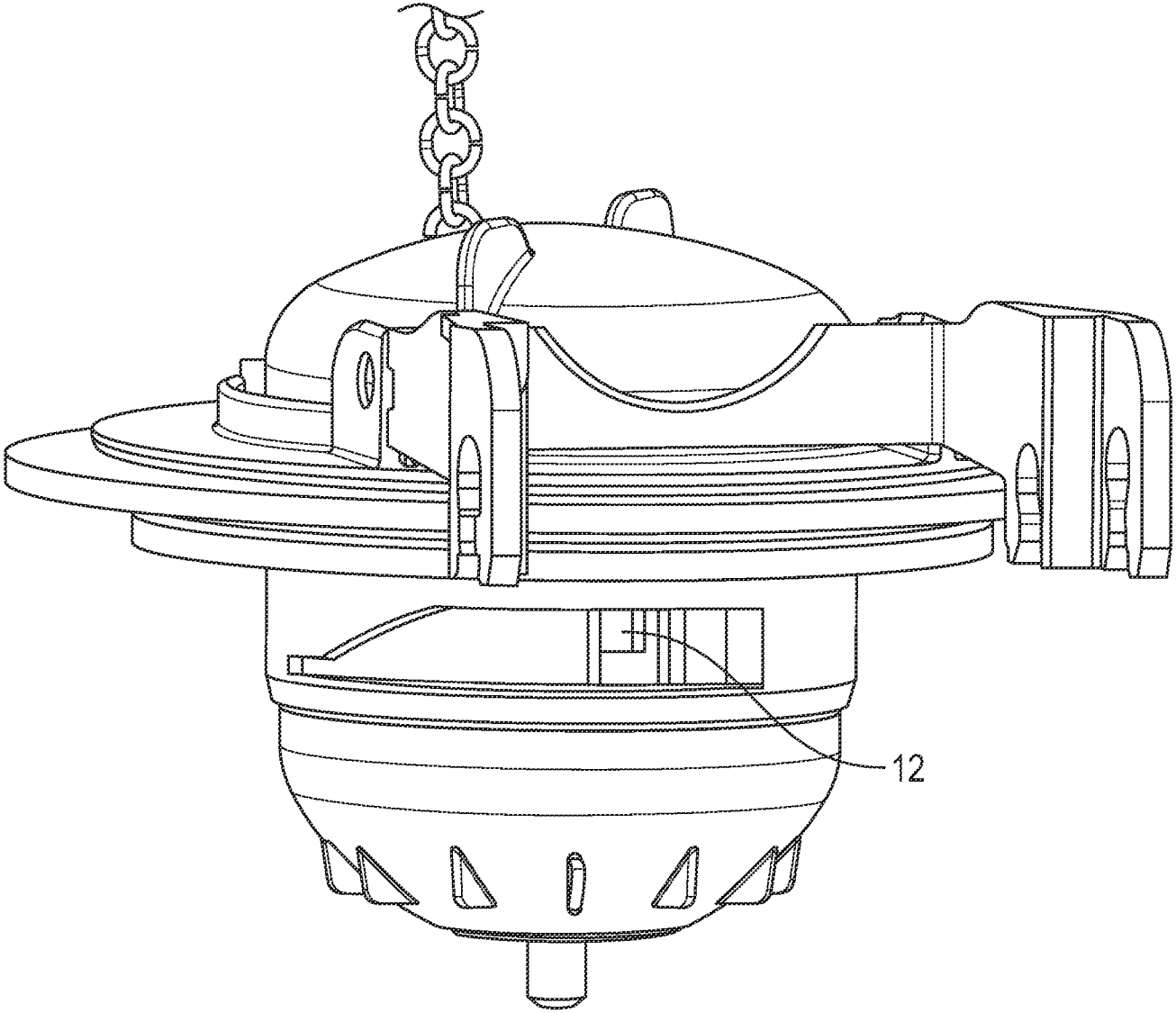
FIG. 11 depicts a rear fully opened adjustable window according to some embodiments.
Figure 12:
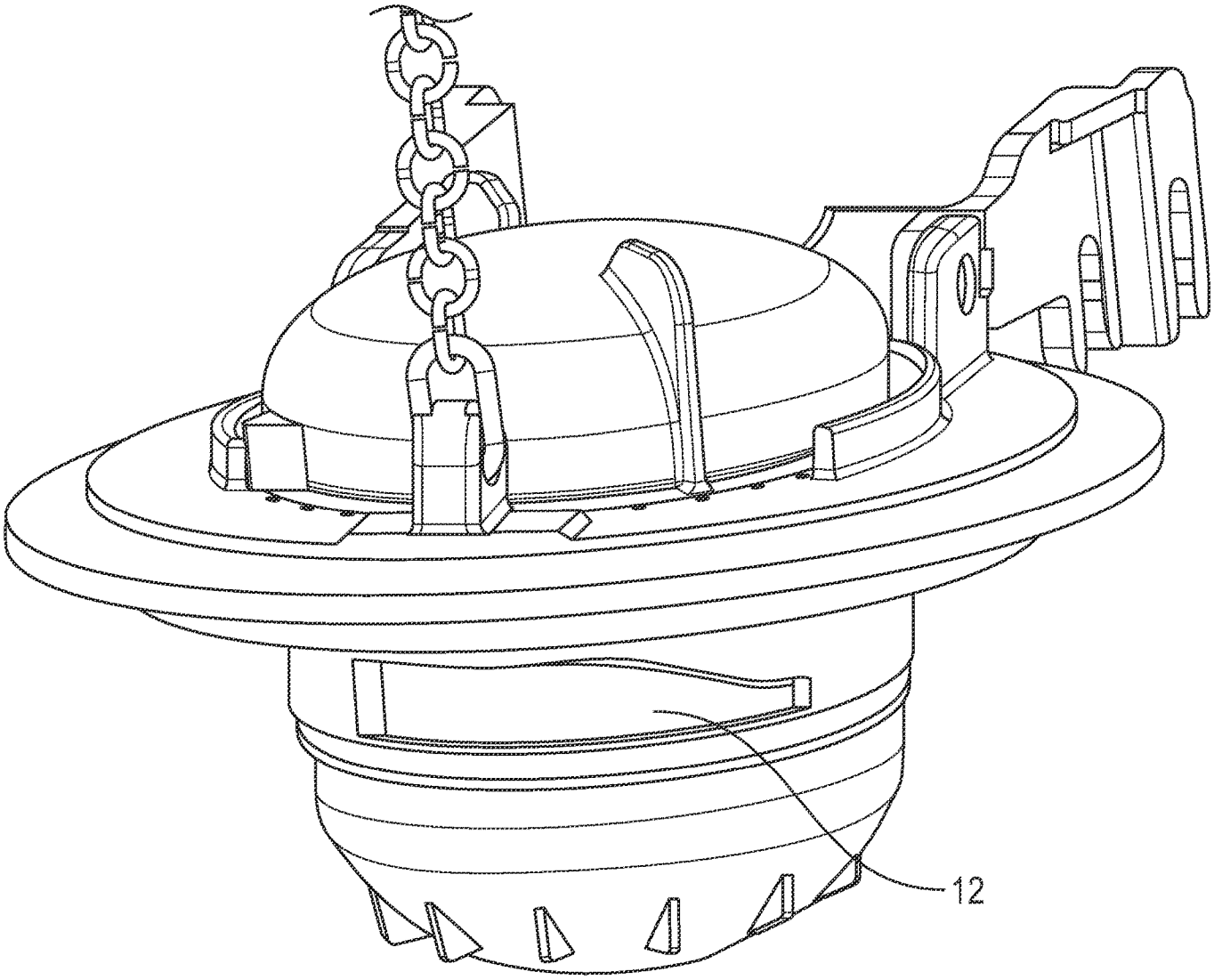
FIG. 12 shows a front adjustable window fully closed for maximum buoyancy according to some embodiments.
Figure 13:
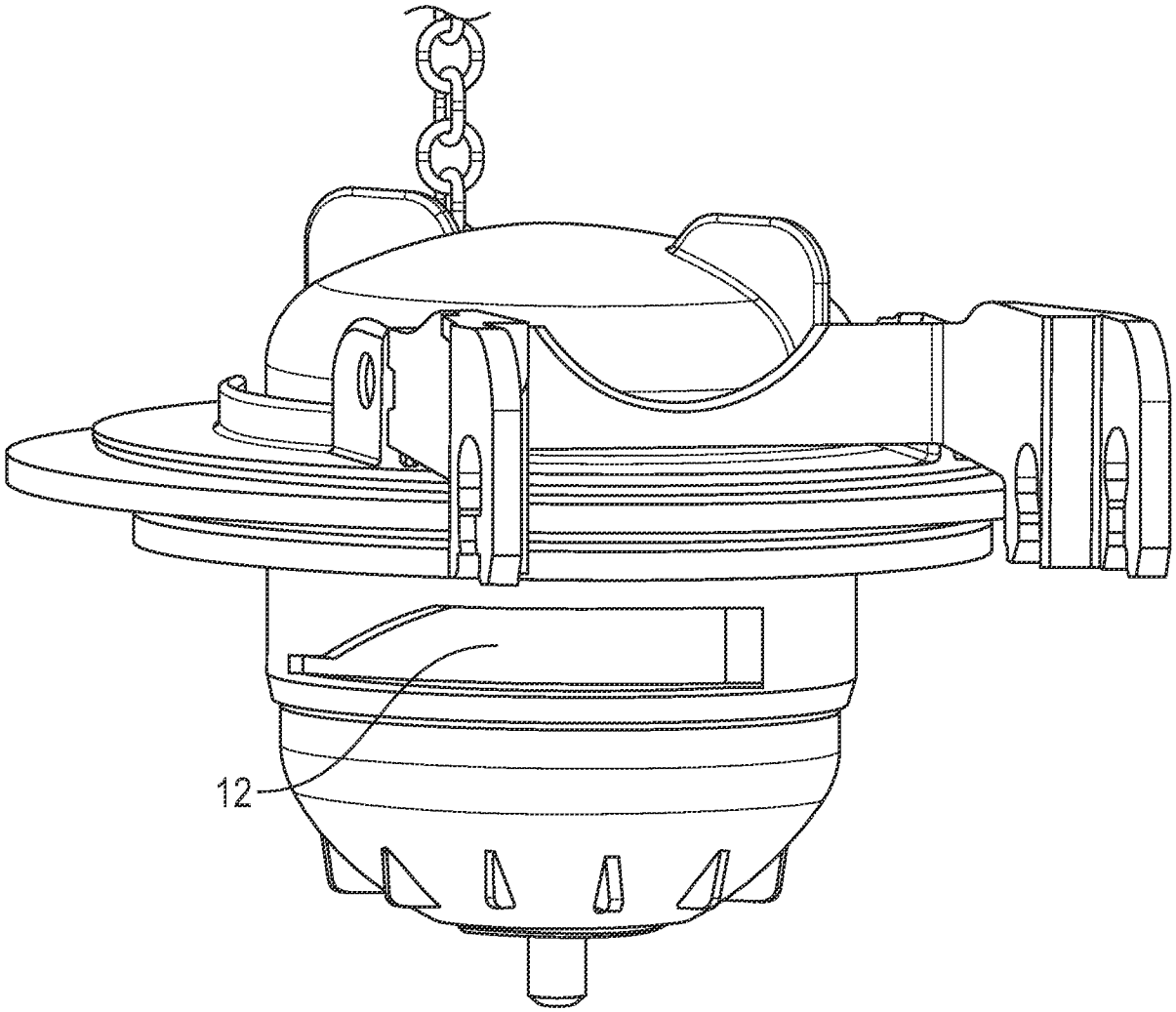
FIG. 13 shows a rear buoyancy adjustment window fully closed according to some embodiments.

FIG. 10 illustrates a front fully opened buoyancy adjustment window 12 for minimum buoyancy according to some embodiments. FIG. 11 depicts a rear fully opened buoyancy adjustment window 12 according to some embodiments. FIGS. 10 and 11 also illustrate the location of an adjustment indicator 62 configured to indicate an open amount of the adjustment window 12. FIG. 12 shows a front buoyancy adjustment window 12 fully closed for maximum buoyancy according to some embodiments. FIG. 13 shows a rear buoyancy adjustment window 12 fully closed according to some embodiments.

Figure 14:
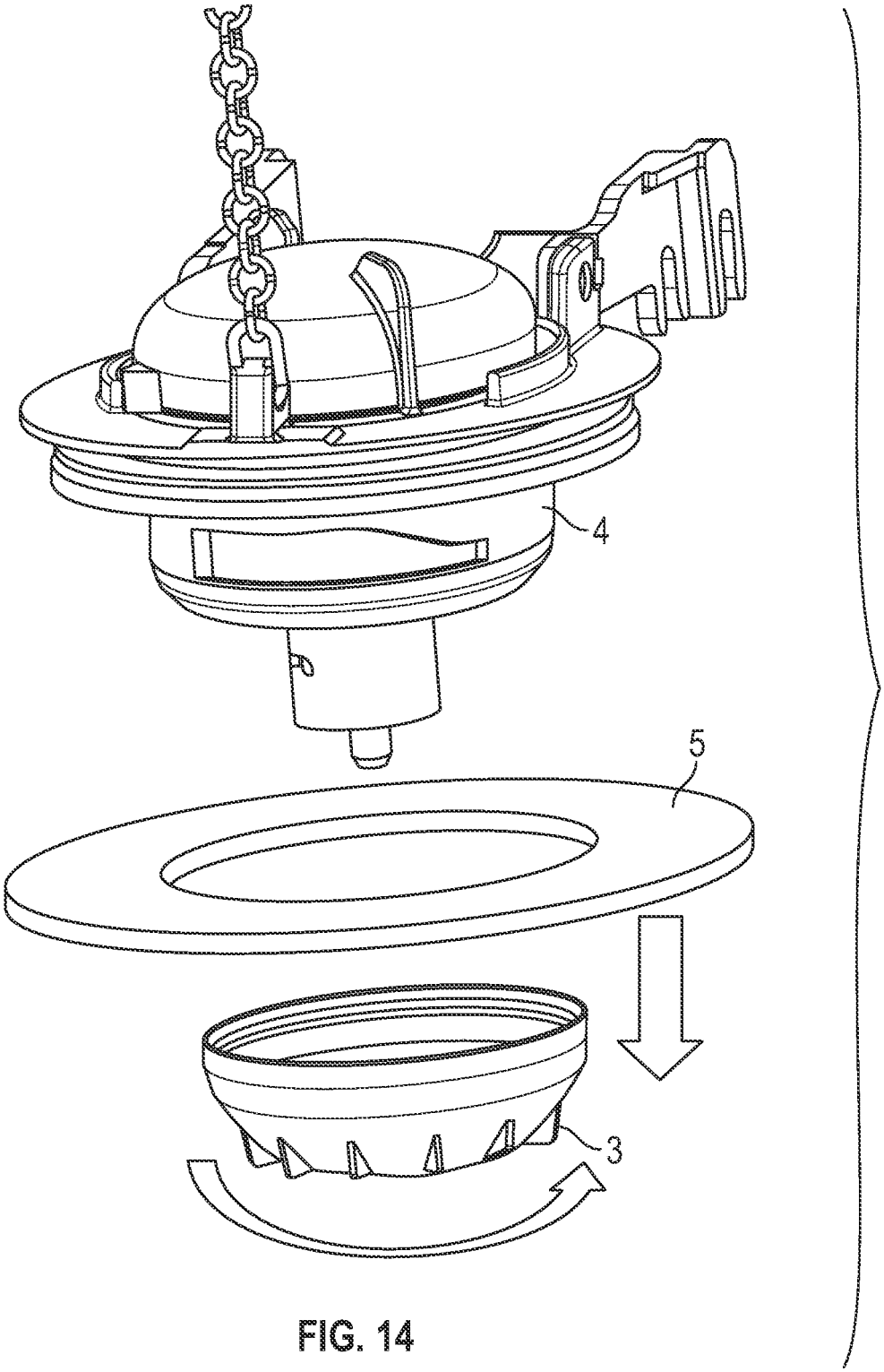
FIG. 14 illustrates removing the large lower buoyancy dome for selective gasket attachment according to some embodiments.
Figure 15:
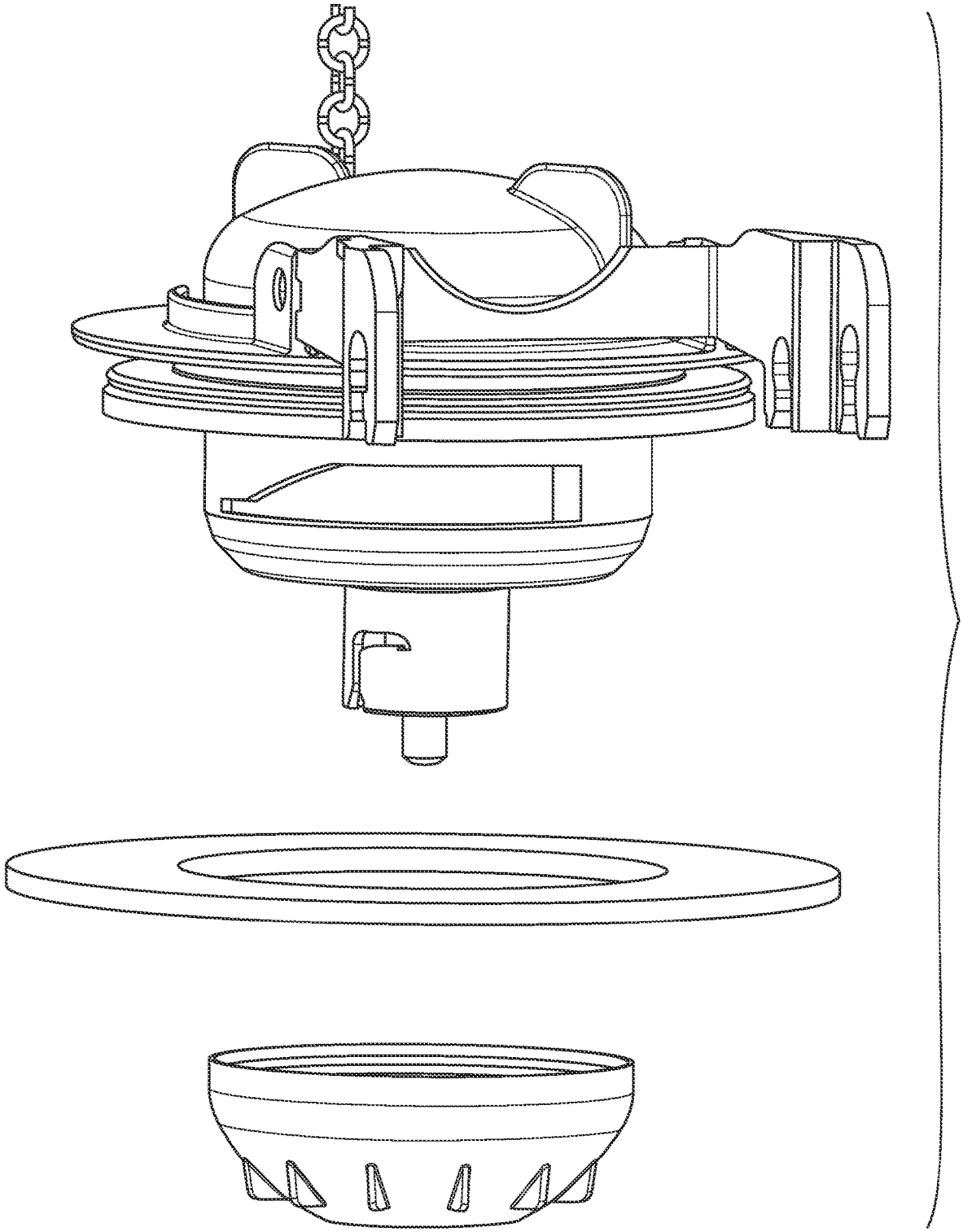
FIG. 15 depicts another view of removing the lower buoyancy dome for selective gasket attachment according to some embodiments.
Figure 16:
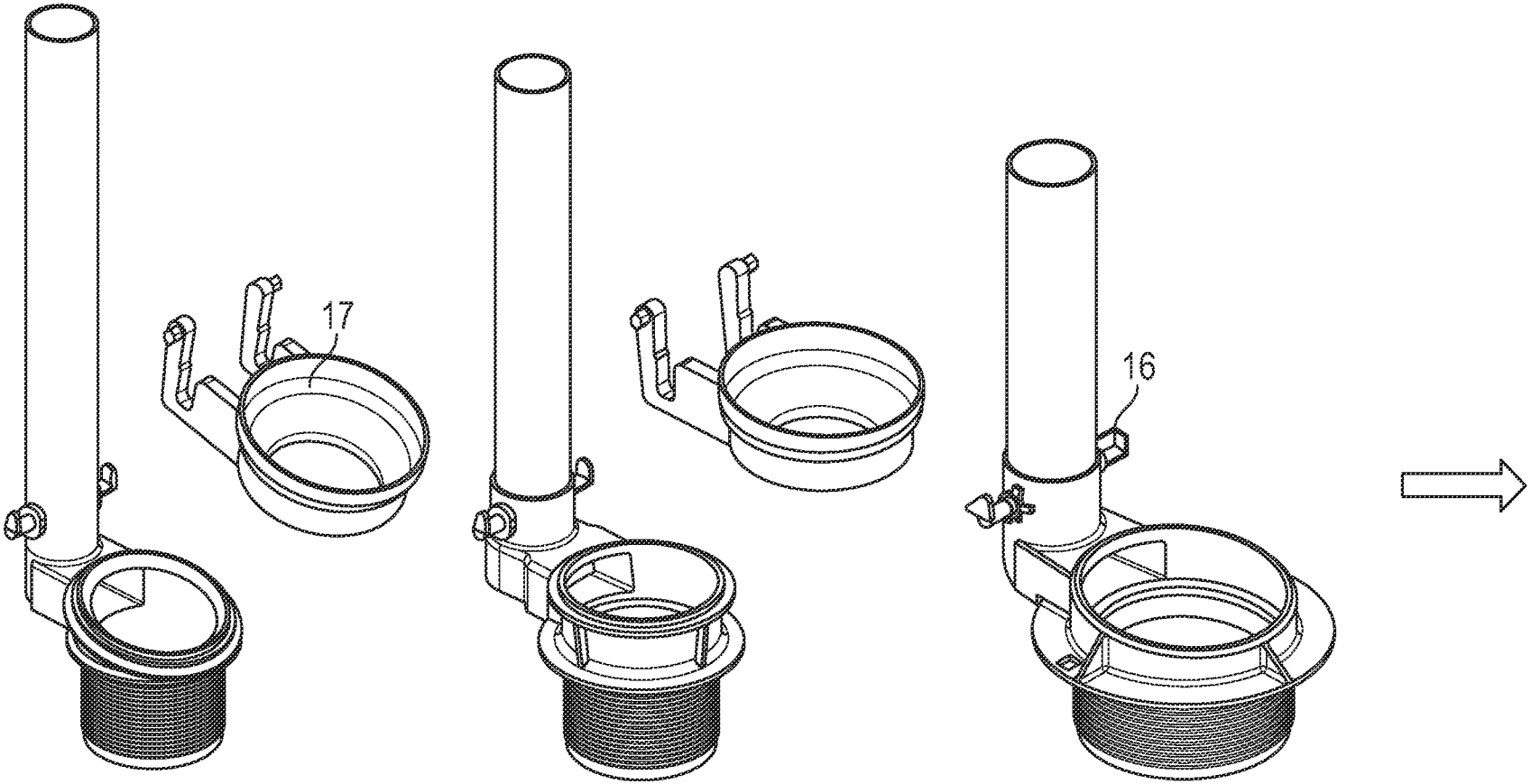
FIG. 16 illustrates a method of using the combination flapper system with an upper and lower dome removed then assembled and installed according to some embodiments.
Figure 16:
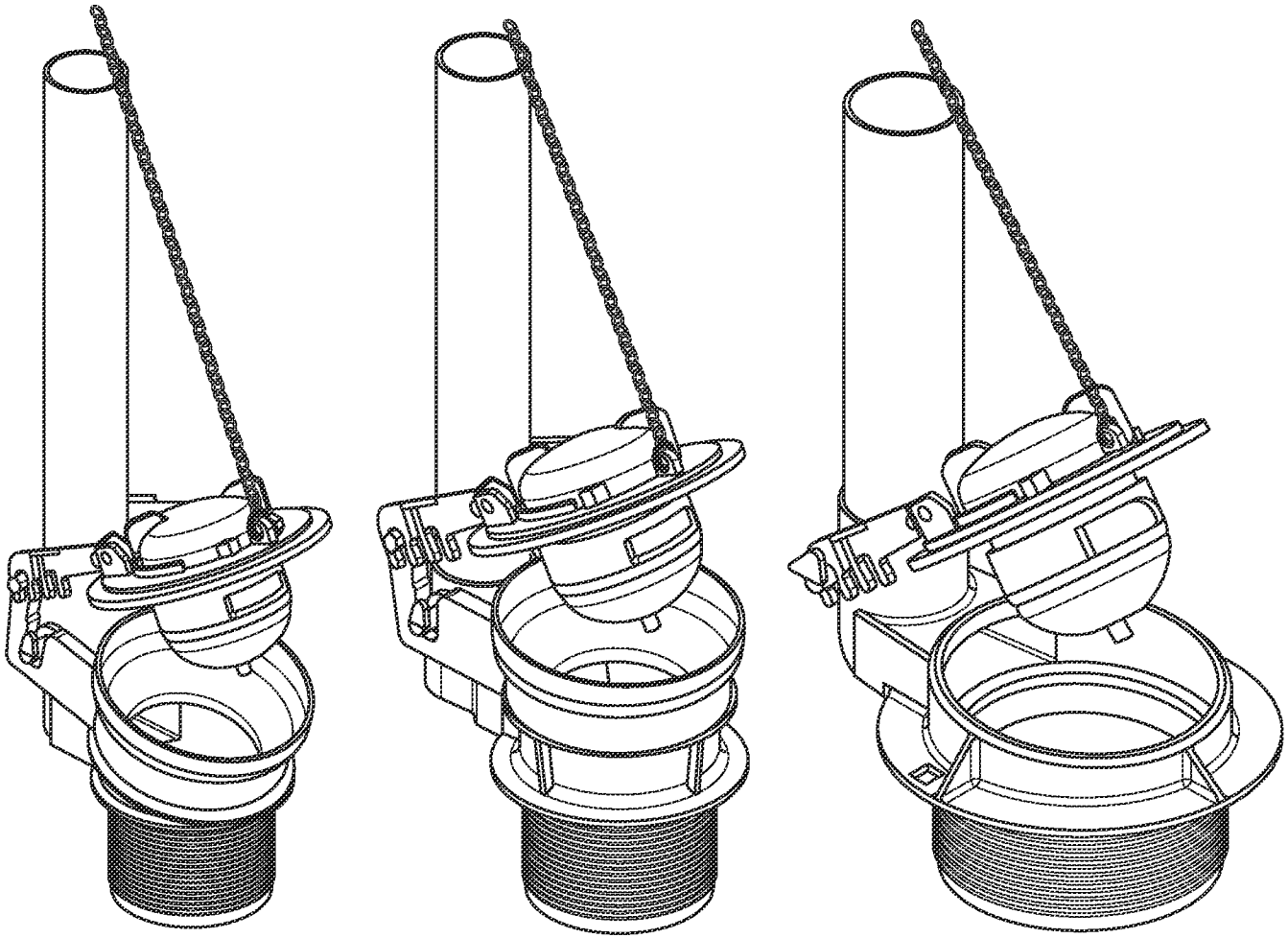

FIG. 14 illustrates removing the second lower buoyancy dome 3 for second flush valve seal 5 (large gasket) attachment according to some embodiments. FIG. 15 depicts another view of FIG. 14 according to some embodiments. FIG. 16 illustrates a method of using the combination flapper system on an angled 2" flush valve, a flat 2" flush valve, and a 3" flush valve with an adaptor 17 according to some embodiments. In some embodiments, the adaptor 17 is configured to convert a 2" flush valve to a 3" flush valve.

Figure 17:
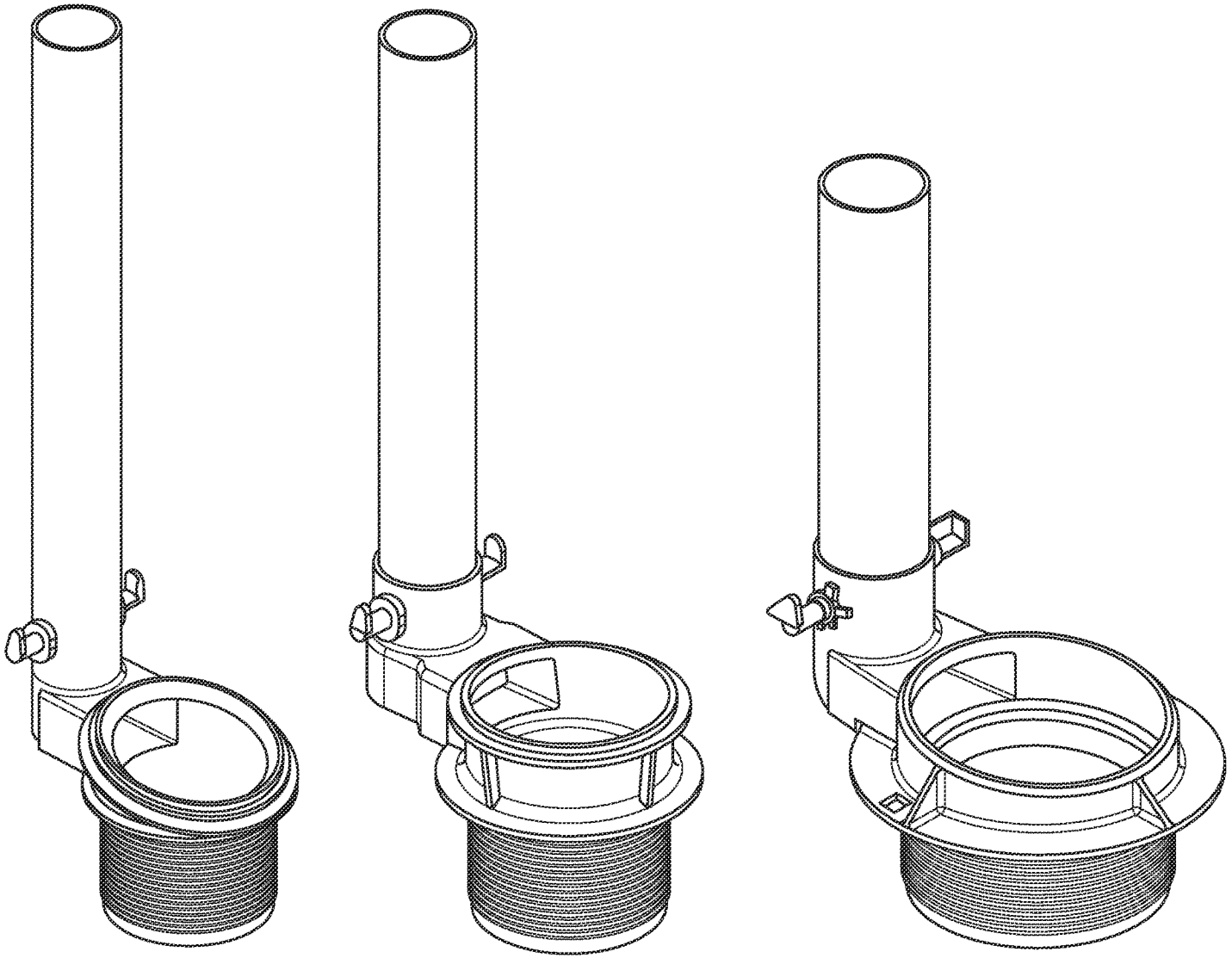
FIG. 17 shows a method of using the combination flapper system with an upper and lower dome assembled and installed according to some embodiments according to some embodiments.
Figure 17:
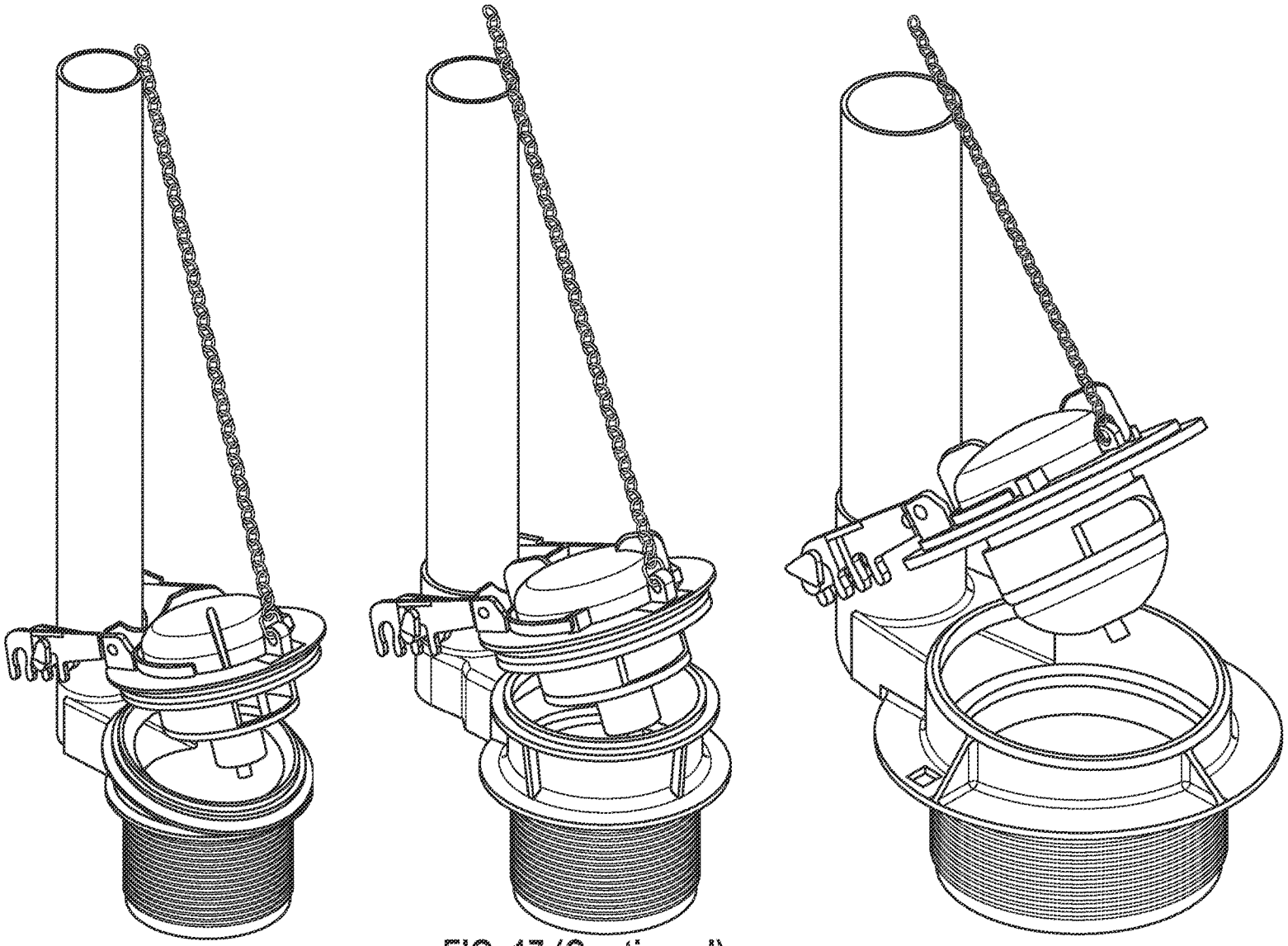

In some embodiments, the adaptor comprises mounting ears configured to enable attachment to the second fulcrum mount 20, where the 2" flush valve is configured to interface with the first fulcrum mount 19. FIG. 17 shows a method of using the combination flapper system on an angled 2" flush valve, a flat 2" flush valve, and a 3" flush valve without an adaptor 17 according to some embodiments.

The one or more mounting arms 1 may be solid as shown in FIG. 2, according to some embodiments, or may comprise one or more separable, rotatable, and/or extendable sections in the form of one or more adjustable fulcrums as further described herein with reference to FIGS. 18-23 according to some embodiments. In some embodiments, the one or more adjustable fulcrums include one or more adjustable pivots according to some embodiments. In some embodiments, the one or more adjustable pivots include one or more pivots 15. In some embodiments, the one or more pivots 15 are configured to enable the flapper main body 8 to rotate at an angle to match the angle of a conventional angled valve seat and/or a conventional flat (standard) valve seat. In some embodiments, the one or more pivots 15 include one or more pivot locks (e.g., interference locks) configured to secure the one or more body pivots 15 in a fixed position. In some embodiments, the one or more pivots 15 are free to rotate.

In some embodiments, the one or more mounting arms 1 of the flapper system may comprise one or more separable, rotatable, and/or extendable arm members in the form of one or more adjustable fulcrums. When the one or more separable, rotatable, and/or extendable arm members are attached, adjustable fulcrums for 2" and/or 3" flush valve attachment may be selectively employed. When the one or more separable, rotatable, and/or extendable arm members are removed, only non-adjustable fulcrums for 2" flush valve attachment may be employed.

In some embodiments, the non-adjustable fulcrums for 2" and 3" flush valve attachment have the same form and geometry. In some embodiments, the non-adjustable fulcrums for 2" and 3" flush valve attachment are not the same in form and geometry. In some embodiments, the non-adjustable fulcrums for 2" and 3" flush valve attachment have the same form and geometry for both the left-side and the right-side arm members. In some embodiments, the non-adjustable fulcrums for 2" and 3" flush valve attachment do not have the same form and geometry for the left-side and right-side arm members.

Figure 18:
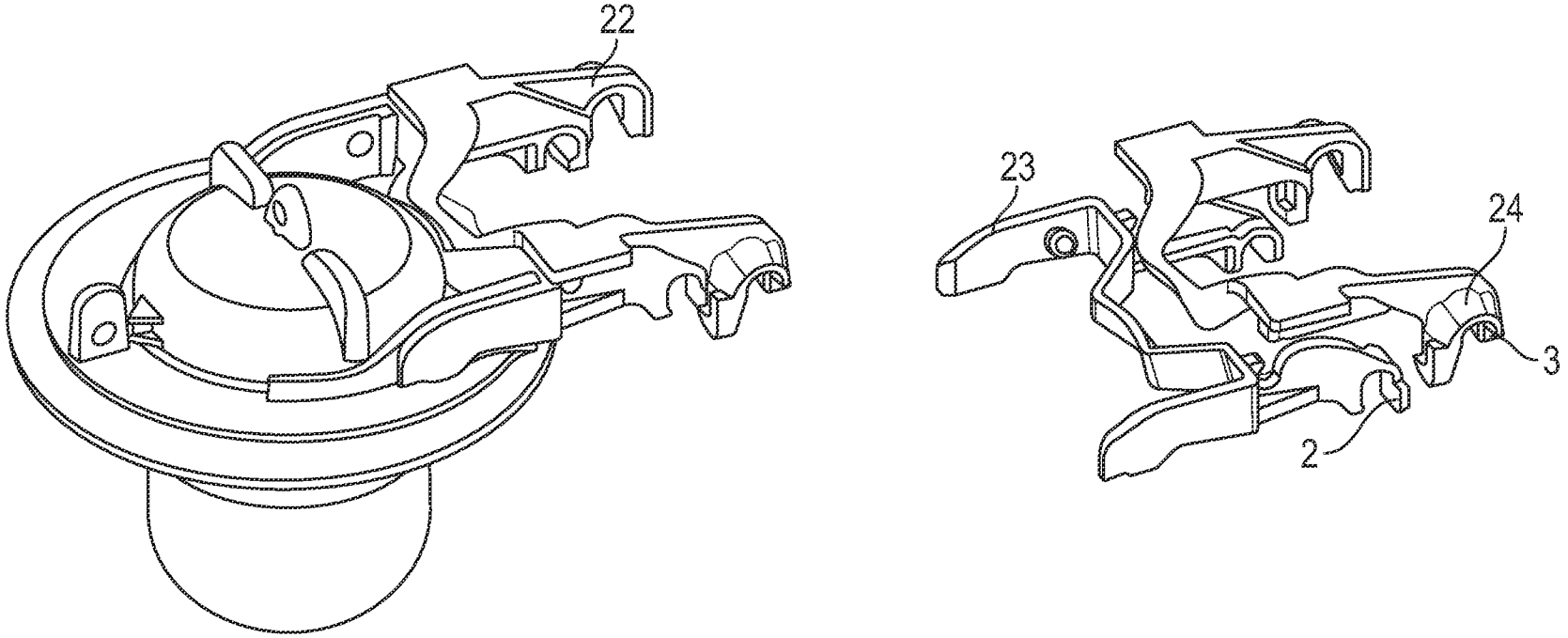
FIG. 18 depicts a snap-on arm arrangement for adjustable fulcrums according to some embodiments.
Figure 18:
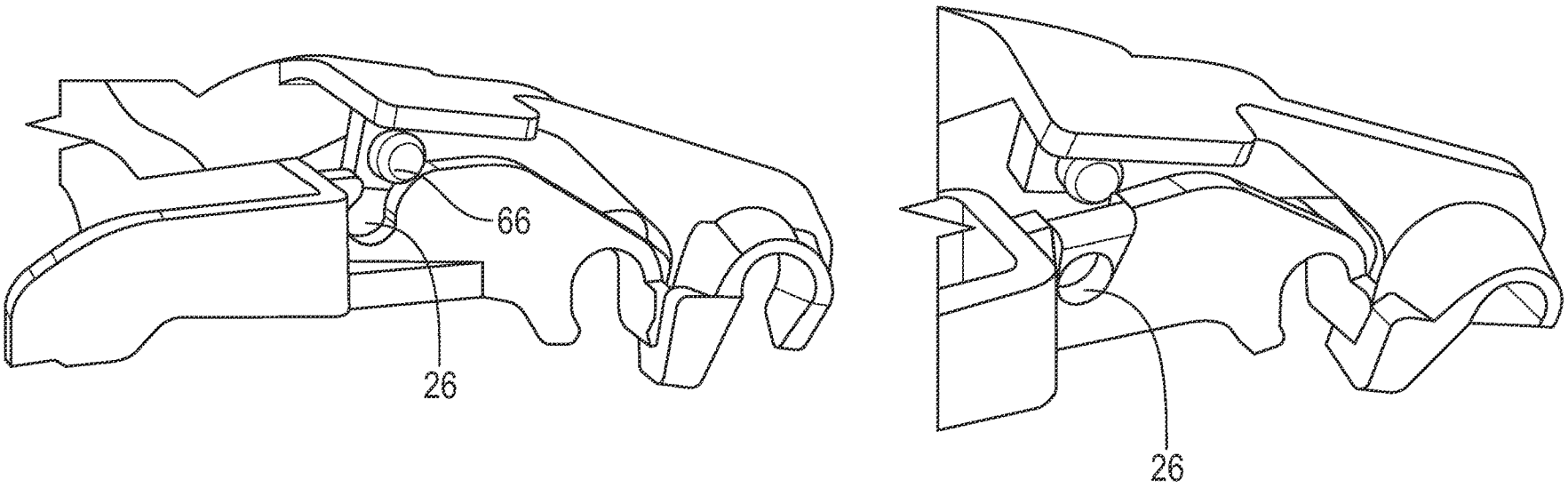

FIG. 18 shows adjustable fulcrums in the form of snap-on arms 22 according to some embodiments. In some embodiments, the one or more (separable) (e.g., 3") second mounting arms 24 of the toilet valve flapper assembly is securely attached to the (e.g., 2") one or more (separable) first mounting arms 23 via a pin and slot engagement. In some embodiments, instead of the slot 25, a hole 26 is provided for engagement with the pin 66. In some embodiments, a kit comprises the one or more first mounting arms 23 and the one or more second mounting arms 24 as separate pieces. In some embodiments, separate pieced provide the benefit of accommodating various sizes such as 2" and 3" flush valves without taking up additional space when an extension is not needed. In some embodiments, the one or more first mounting arms 23 and the one or more second mounting arms 24 are integral.

Figure 19:
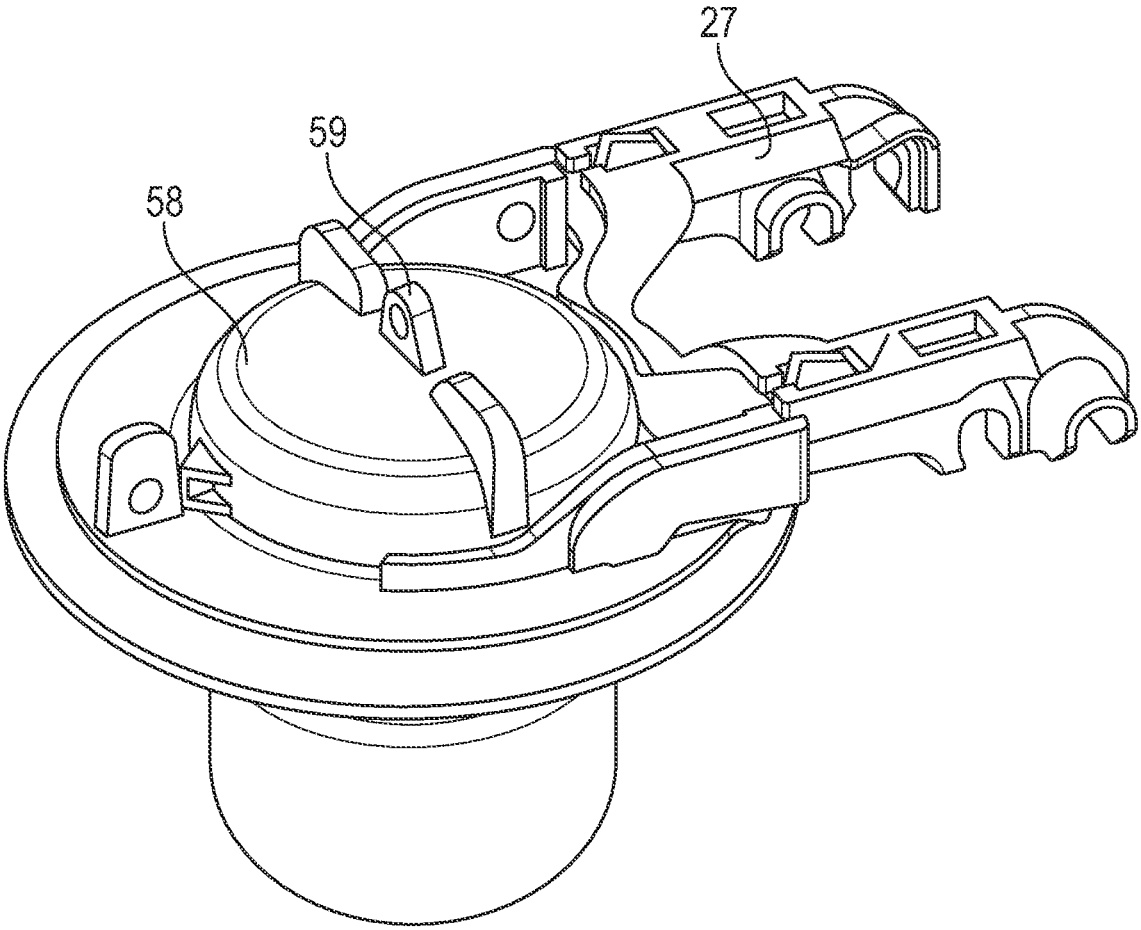
FIG. 19 shows a track-lock arm arrangement for adjustable fulcrums according to some embodiments.
Figure 19:
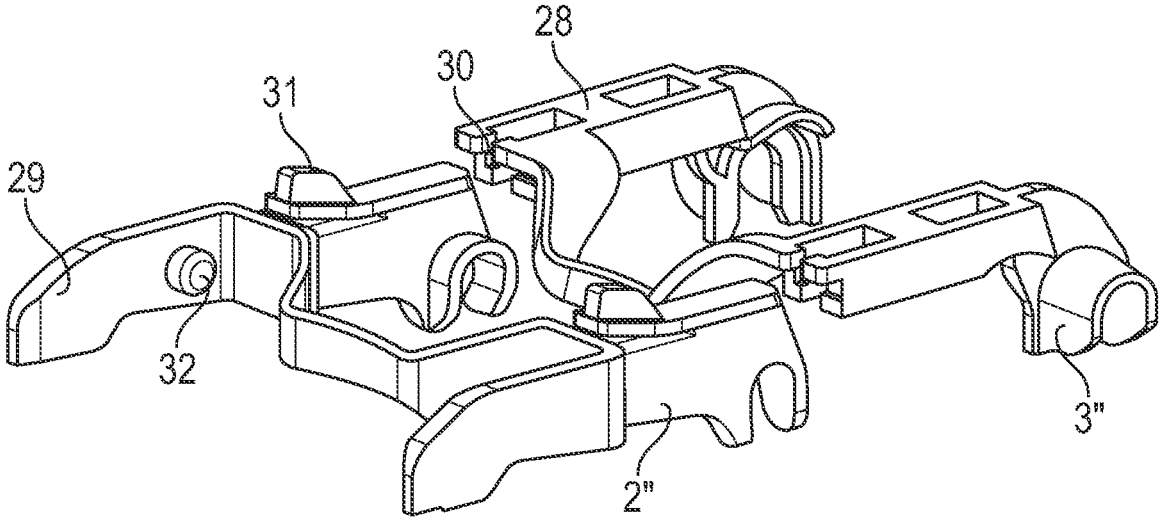

FIG. 19 shows adjustable fulcrums in the form of one or more track-lock arms 27 according to some embodiments. In some embodiments, the one or more track-lock arms 27 include one or more second (e.g., 3") mounting arm 28. In some embodiments, the one or more second mounting arms 29 are configured to securely couple to the one or more first mounting arms 29 via a sliding track 30 and tab 31 engagement. To detach the separable 3" mounting arm member from the 2" arm member, the one or more tabs 31 are first pressed to disengage locking and the one or more second mounting arms 28 are pulled apart from the one or more first mounting arms 29 each other by a sliding action. In some embodiments, the first mounting arm is configured to be pivotally attached to the flapper main body 8 by one or more pins 32, as are any of the first (e.g., 2") mounting arms described herein. In some embodiments, the upper buoyancy dome 58 comprises a link fastener 59 configured to attach to one or more linkages, such as a chain as a non-limiting example. In some embodiments, the link fastener 59 is located at the center of the upper buoyancy dome 58. In some embodiments, the link fastener 59 is not located at the center of the upper buoyancy dome 58. In some embodiments, the link fastener can be located at one or more of the front, rear, left, and right sides of the upper buoyancy dome 58. In some embodiments, the link fastener 59 can be located anywhere on the flapper system. In some embodiments, the link fastener 59 is integral to the upper buoyancy dome.

Figure 20:
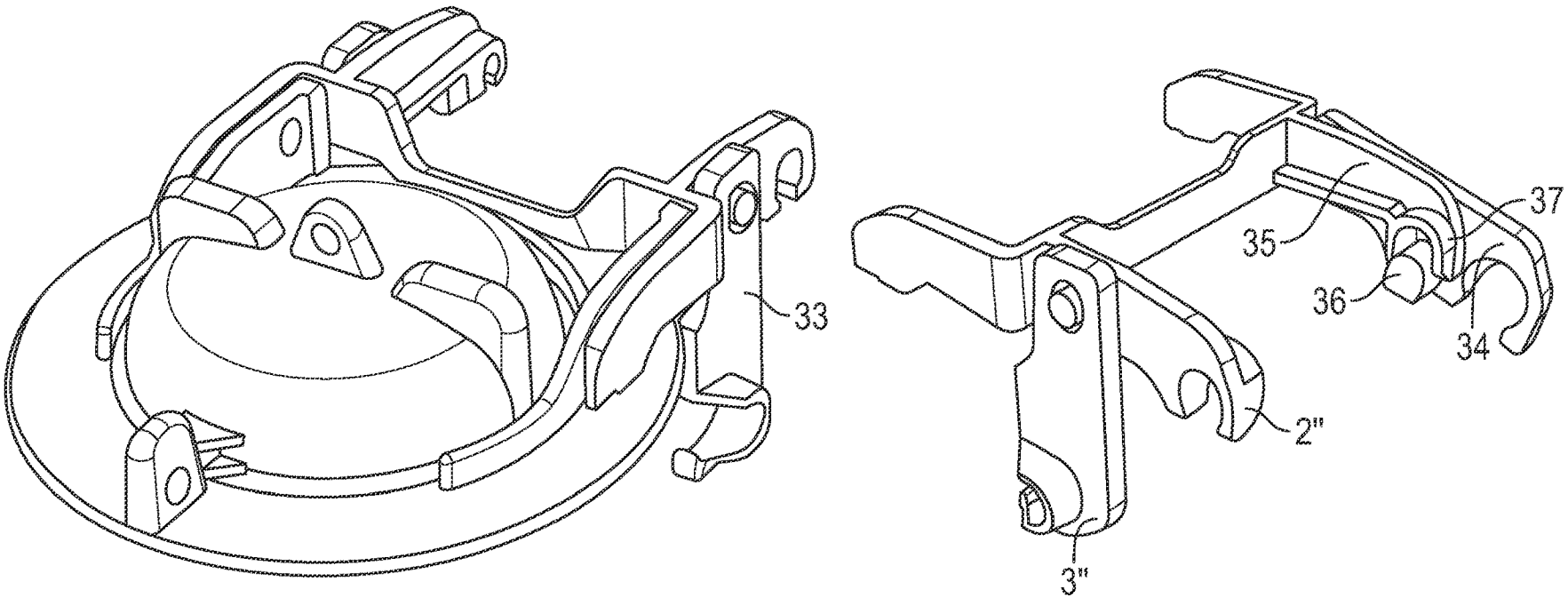
FIG. 20 illustrates a swing arm arrangement for adjustable fulcrums according to some embodiments.

FIG. 20 shows adjustable fulcrums in the form of one or more swing arms 33 according to some embodiments. In some embodiments, the one or more swing arms 33 include one or more rotatable second (e.g., 3") mounting arms 34 configured to be securely attached to the one or more first (e.g., 2") mounting arms 35 via one or more pivot pins 36 engaging one or more pivot slots 37. In some embodiments, the one or more second mounting arms 34 are configured to be securely coupled to the one or more first mounting arms 35. In some embodiments, the one or more second mounting arms 34 are configured to be disengaged from the one or more first mounting arms 35, where at least a portion of the one or more second mounting arms 34 are allowed to swing or rotate away from the one or more first mounting arms 35.

Figure 21:
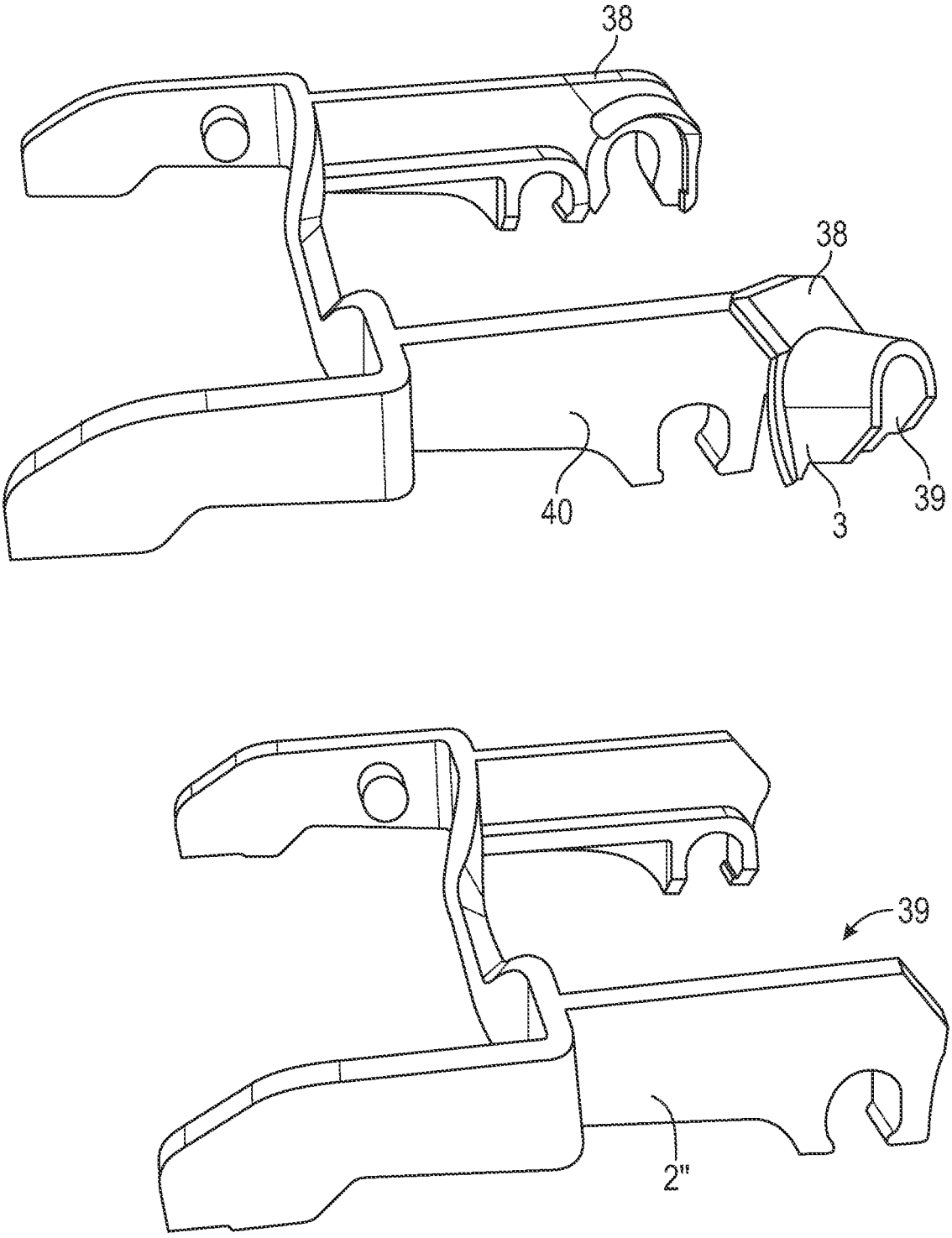
FIG. 21 shows a breakaway arm arrangement for adjustable fulcrums according to some embodiments.

FIG. 21 shows adjustable fulcrums in the form of a break-away arms 38 according to some embodiments. In some embodiments, the one or more separable second (e.g., 3") mounting arms 39 are initially integrally attached to the one or more first (e.g., 2") mounting arms 40. In some embodiments, in the event the fulcrum for a second mounting arm 39 is not needed, it is configured to be separated (e.g., broken away by bending or including a thin section for cutting through or any other separation configuration) from the first mounting arm 40.

Figure 22:
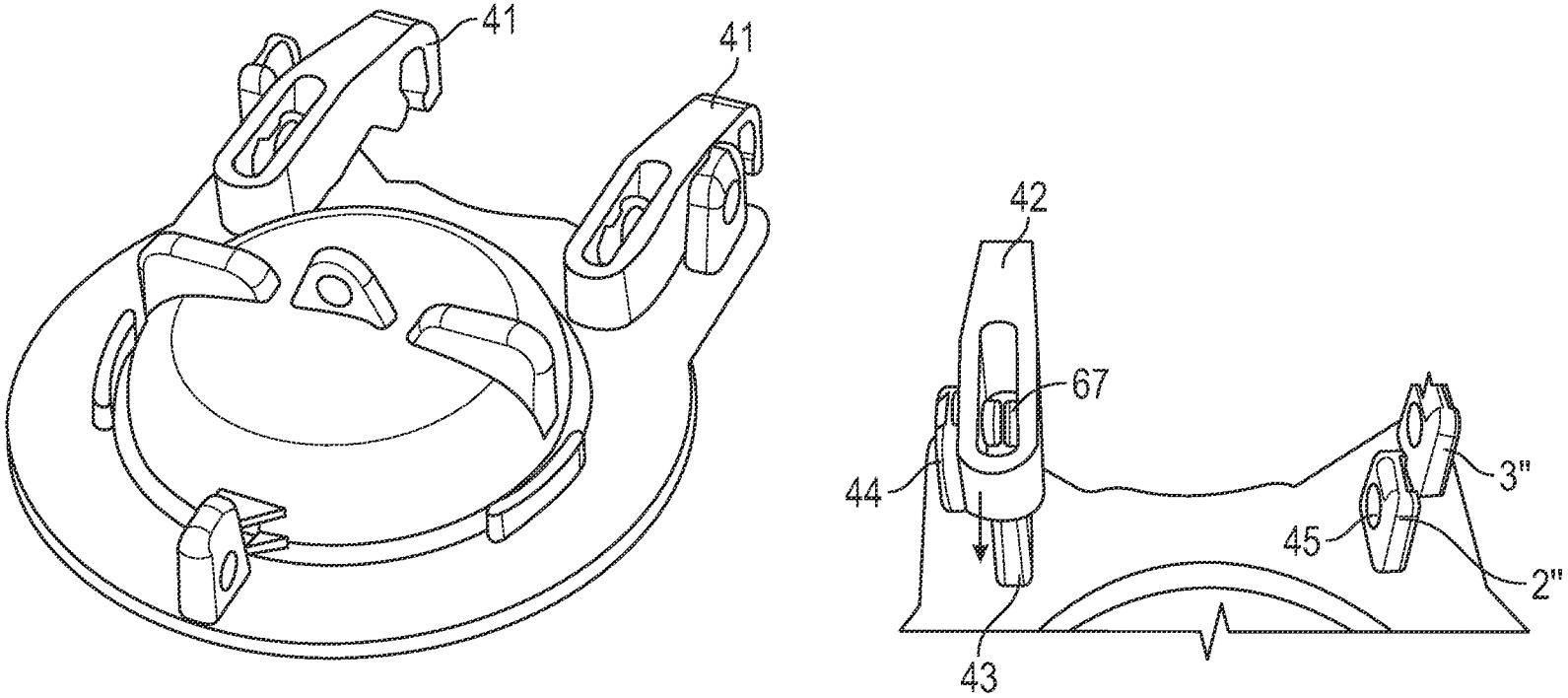
FIG. 22 shows a position transfer arm arrangement for adjustable fulcrums according to some embodiments.

FIG. 22 shows adjustable fulcrums in the form of one or more position transfer arms 41 according to some embodiments. In some embodiments, the one or more position transfer arms 41 comprise one or more separable mounting arms 42 are configured to be selectively positioned on a first tab 43 or a second tab 44 for mounting to a first mount (e.g., 2" flush valve mount) or a second mount (e.g., a 3" flush valve mount). In some embodiments, one or more separable mounting arms 42 may be different in size and/or length. In some embodiments, the one or more separable mounting arms 42 can be secured to the first tab 43 and/or second tab 44 by any conventional fastener such as locking tabs 67 engaging with a hole 45.

Figure 23:
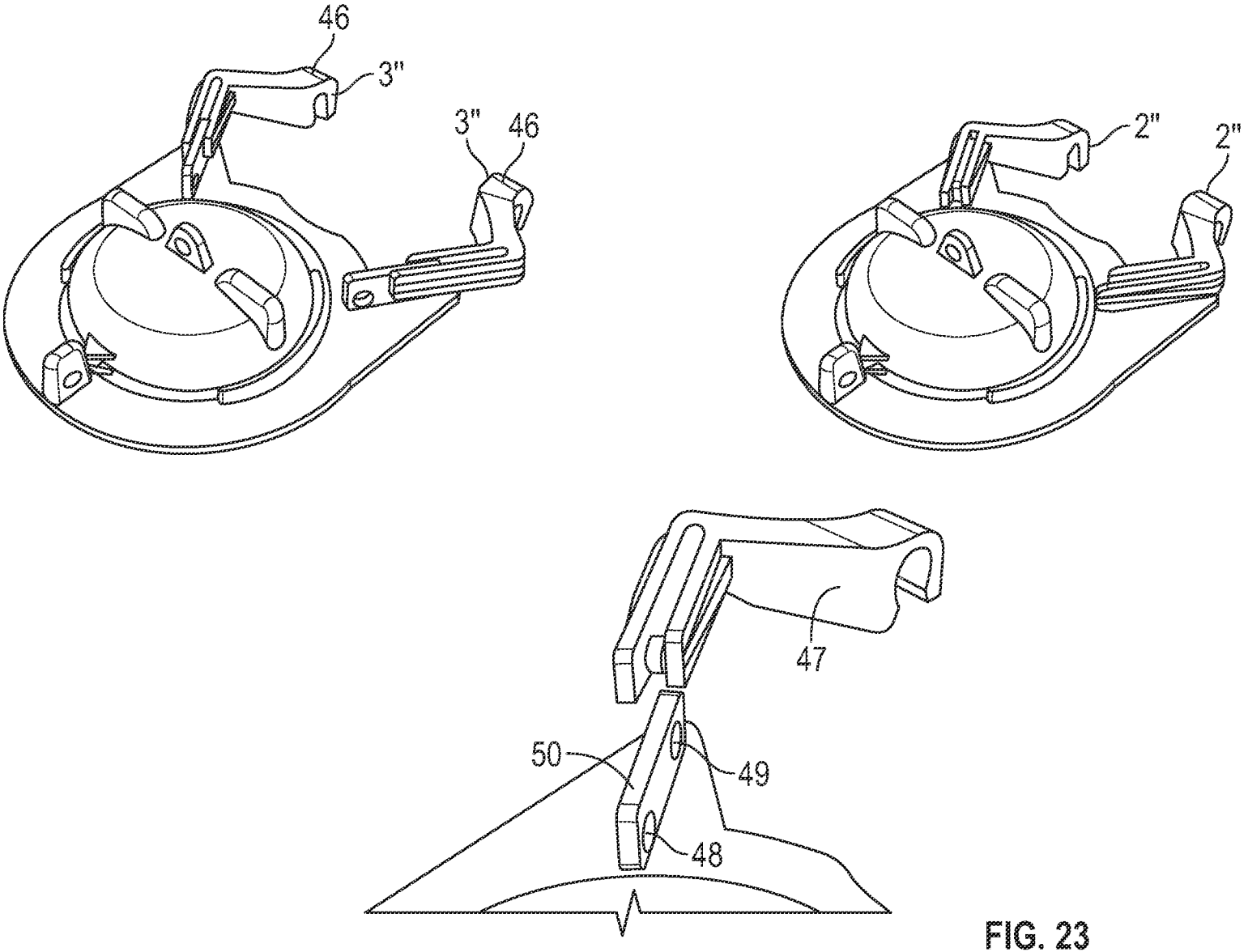
FIG. 23 depicts a divergent arm arrangement for adjustable fulcrums according to some embodiments.

FIG. 23 shows adjustable fulcrums in the form of telescoping arms according to some embodiments. In some embodiments, the telescoping arms include divergence arms 46 according to some embodiments. In some embodiments, divergence arms 46 include one or more extendable mounting arms 47 configured to be removably coupled the flapper main body 8 at a first (e.g., 2") position 48 and/or a second (e.g., 3") position 49. In some embodiments, the first position 48 and the second position 49 are located along an angled mount 50, where an angled mount on one side of the flapper body extends at a different angle from a flapper main body center than another angled mount extends. In some embodiments, one or more extendable arms 47 create a fulcrum configuration where a length is shorter and/or spacing is narrower between left and right sides when they are set at the first position 48 versus the second position 49. In some embodiments, the one or more extendable arms create a configuration where the vertical position of at least a portion of each upper surface of each extendable mounting arm 47, relative to the seal surface, are the same when each are set at the first mounting position and the second mounting position. In some embodiments, the one or more extendable mounting arm upper surfaces are not in the same vertical position, relative to the seal surface, when set at the first mounting position verses the second mounting position.

In some embodiments, the one or more adjustable fulcrums include one or more telescoping arms configured to enable to flapper main body 8 to move toward or away from one or more flush valve flapper attachment protrusions. In some embodiments, the one or more adjustable fulcrums include one or more arm locks (e.g., interference locks) configured to hold the one or more telescoping arms in a fixed position. In some embodiments, this configurability improves the flush valve system fit by enabling custom centering over the flush valve seat.

Figure 24:
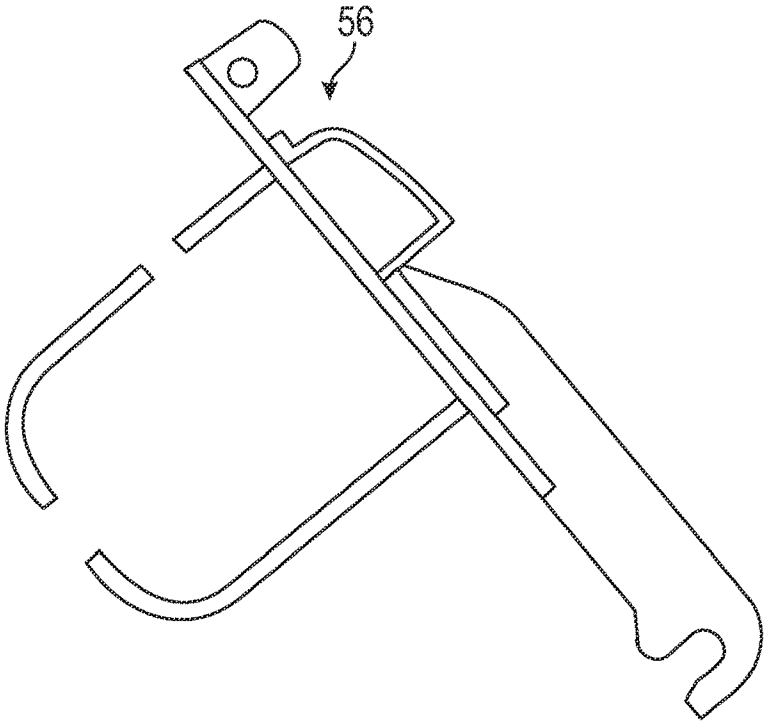
FIG. 24 illustrates an adjustable upper dome according to some embodiments.
Figure 24:
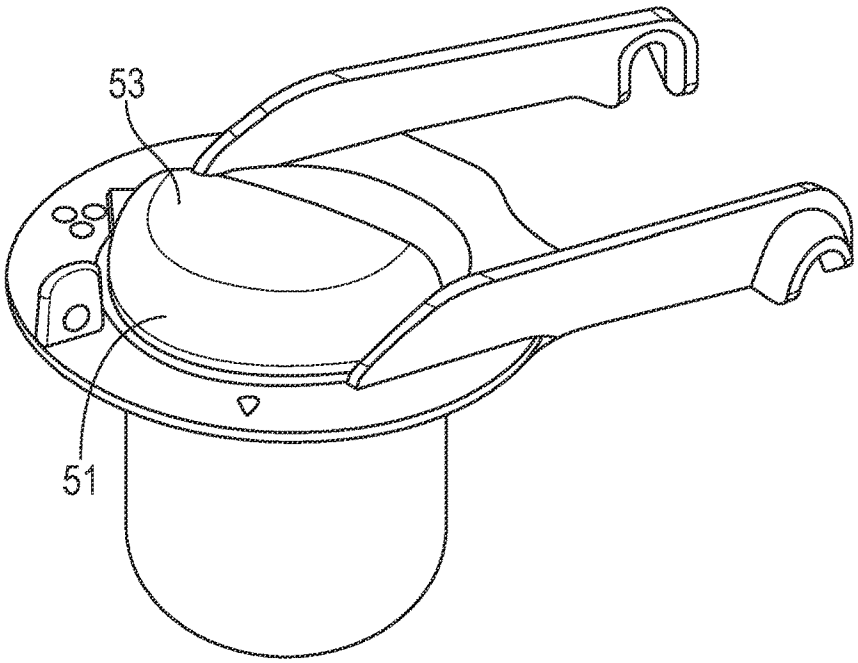
Figure 24:
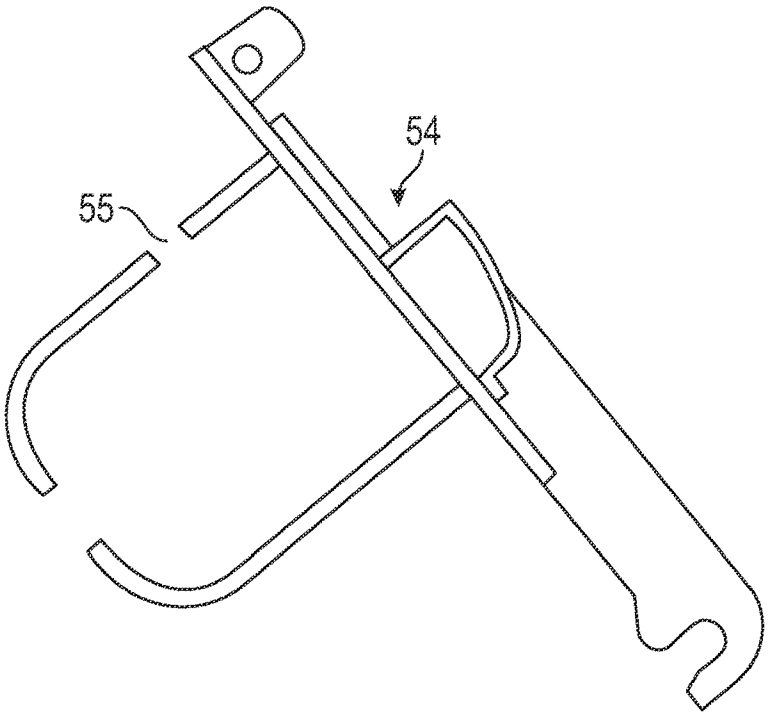
Figure 24:
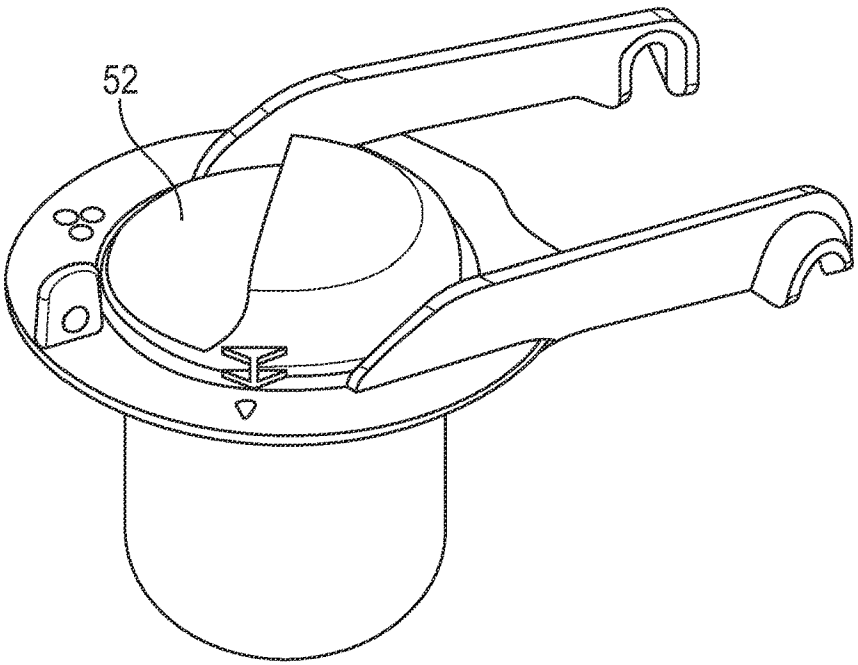

FIG. 24 shows aspects of an adjustable upper dome 51 according to some embodiments. In some embodiments, the adjustable upper dome 51 comprises one or more depressed sections 52. In some embodiments, the adjustable upper dome 51 is configured to be adjustable to different positions to change the amount of buoyancy exhibited by the flapper system during the toilet flush actuation. In some embodiments, in a first position 54, the adjustable upper dome is arranged where the depressed section 52 reduces the trapped air space under the adjustable buoyancy dome when the flapper system is in a raised (angled up) position. In some embodiments, in a first position 54 the depressed section is above the water level and the raised section is below the water level and the air bleed 55 (e.g., window 12). In some embodiments, the raised portion is configured to be at least 70% full of liquid from the tank when in the first position, where at least 70% of the volume is below a horizontal line extending from a top of the air bleed 55 when the flapper system is raised and/or pivoted upward. In some embodiments, the window 12 forms the air bleed 55. In some embodiments, the first position 54 minimizes buoyancy when the flapper assembly is pulled up during the toilet flush actuation.

In some embodiments, in a second position 56, the adjustable upper dome is configured to be adjusted with the raised section 53 above the water line and/or the air bleed. In some embodiments, at least 70% of the volume of the raised portion is above a horizontal line extending from the air bleed and/or the water line when the flapper system is in a raised/pivoted/lifted position. In some embodiments, this adjustable upper dome second position 56 traps air within the raised section volume when the level of fluid in the tank is above the horizontal line extending from the air bleed 55. In some embodiments, this trapped air increases and/or maximizes buoyancy and the flush time when the flapper assembly is pulled up during the toilet flush actuation. In some embodiments, the flapper system adjustable upper dome is configured to be adjusted to a position in-between the first position 54 and second position 56. In some embodiments, the flapper system adjustable upper dome with one or more depressed sections 52 are configured to retain water which act as ballast and aid to close the flapper system if when the flapper assembly is pulled up during the toilet flush actuation.

Figure 25:
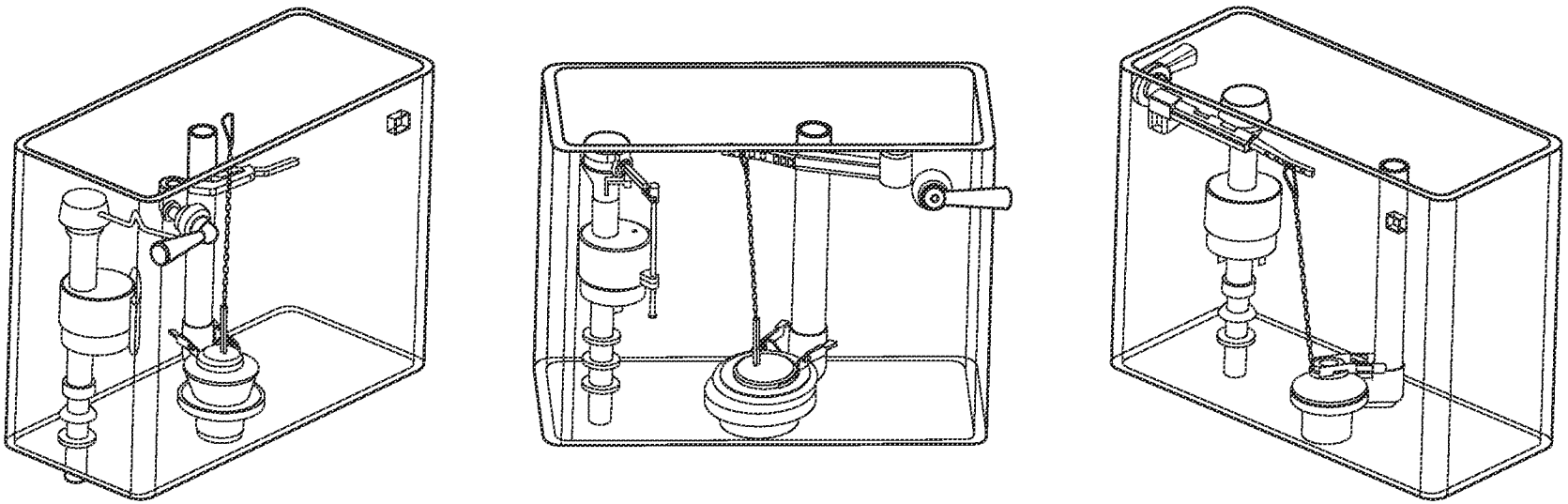
FIG. 25 (Prior Art)
FIG. 25 illustrates the various cistern configurations a consumer may encounter according to some embodiments.
Figure 26:
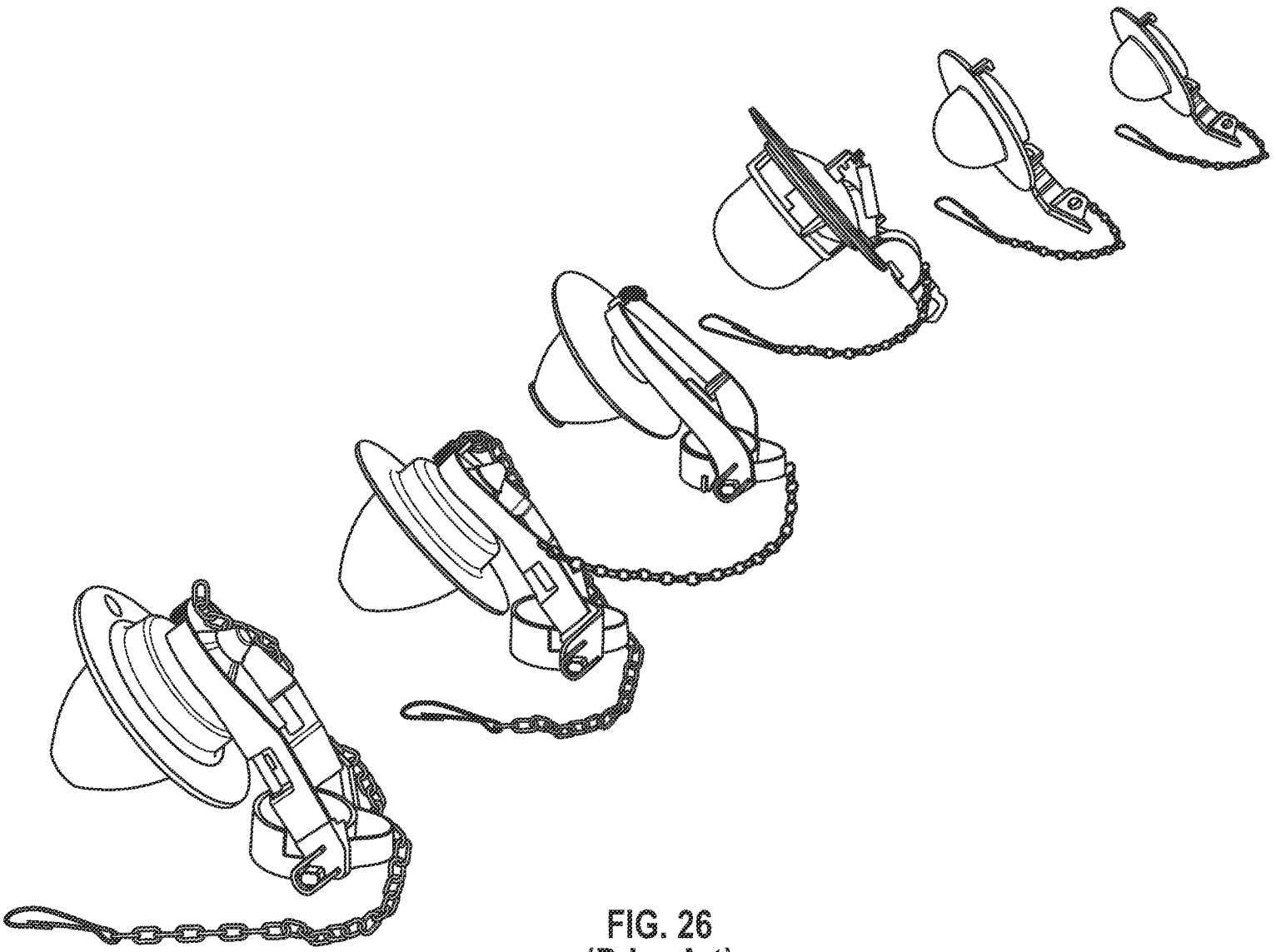
FIG. 26 (Prior Art)
FIG. 26 shows non-limiting examples of flapper types that can be replaced with the combination flapper system according to some embodiments.
Figure 27:
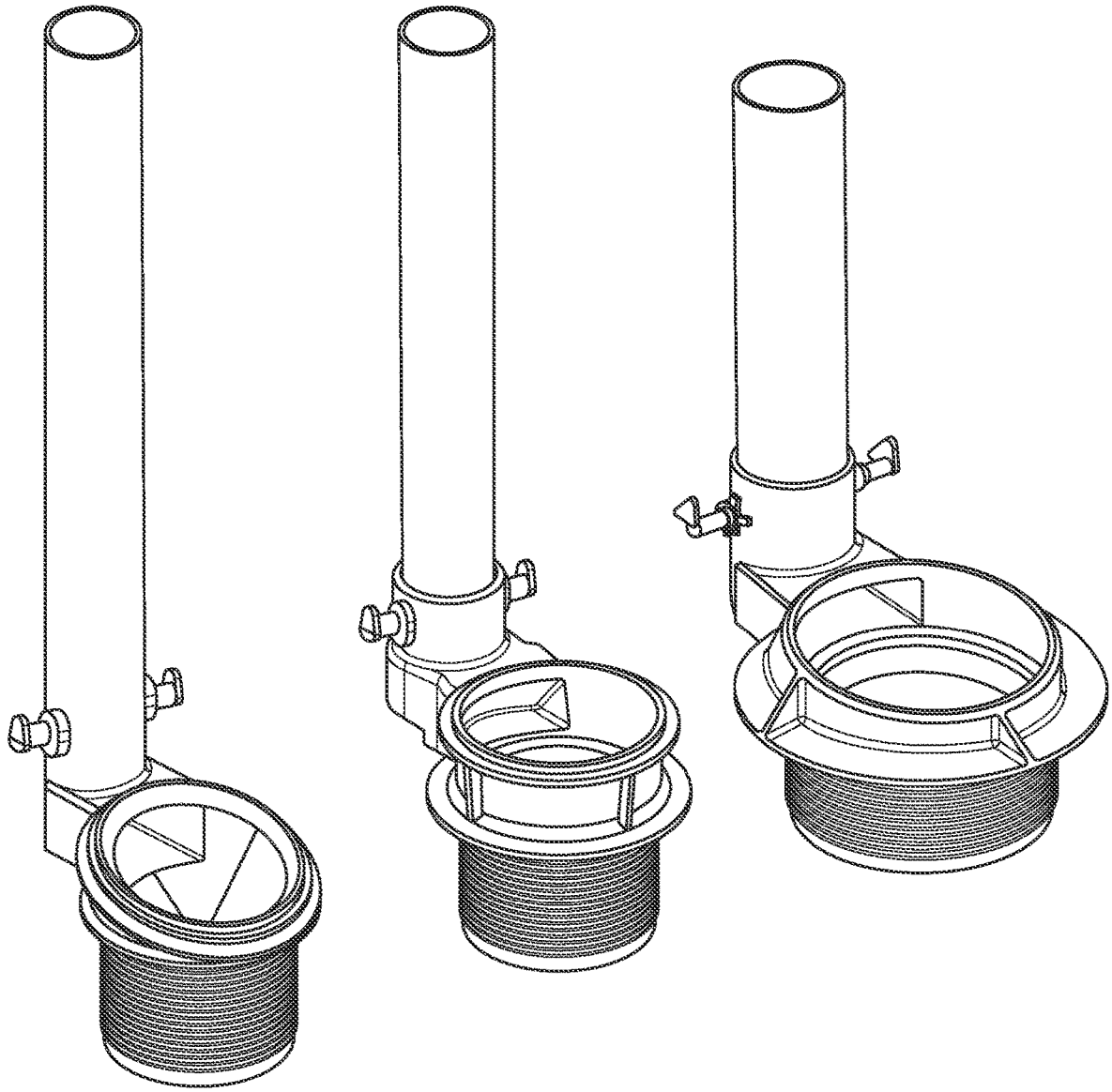
FIG. 27 illustrates, from left to right, a 2" angled seat valve, a 2" seat valve, and a 3" valve that are compatible with the flapper system according to some embodiments.
Figure 28:
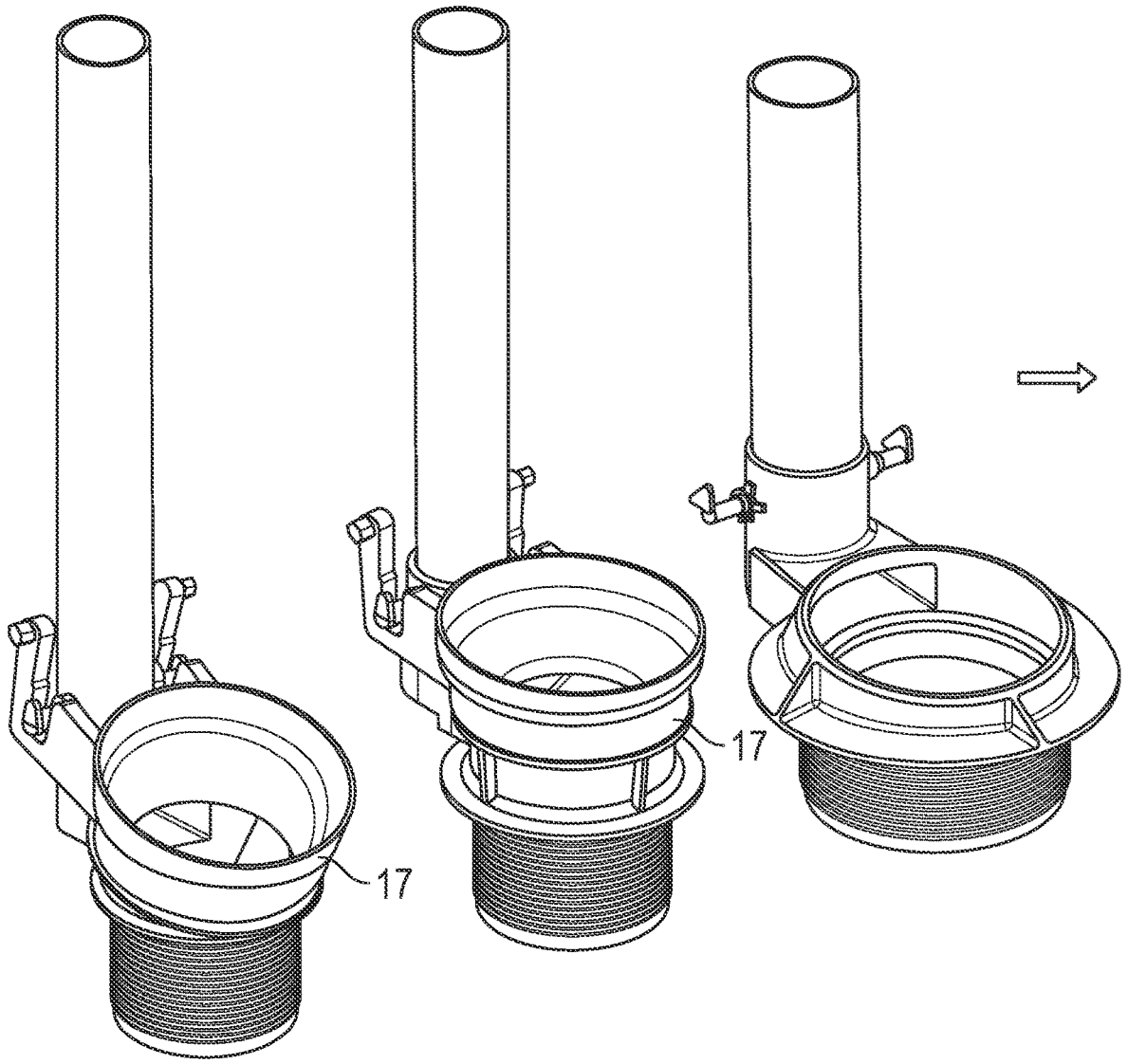
FIG. 28 shows a first option for installing the flapper system on the three different types of valves using a system adaptor according to some embodiments.
Figure 28:
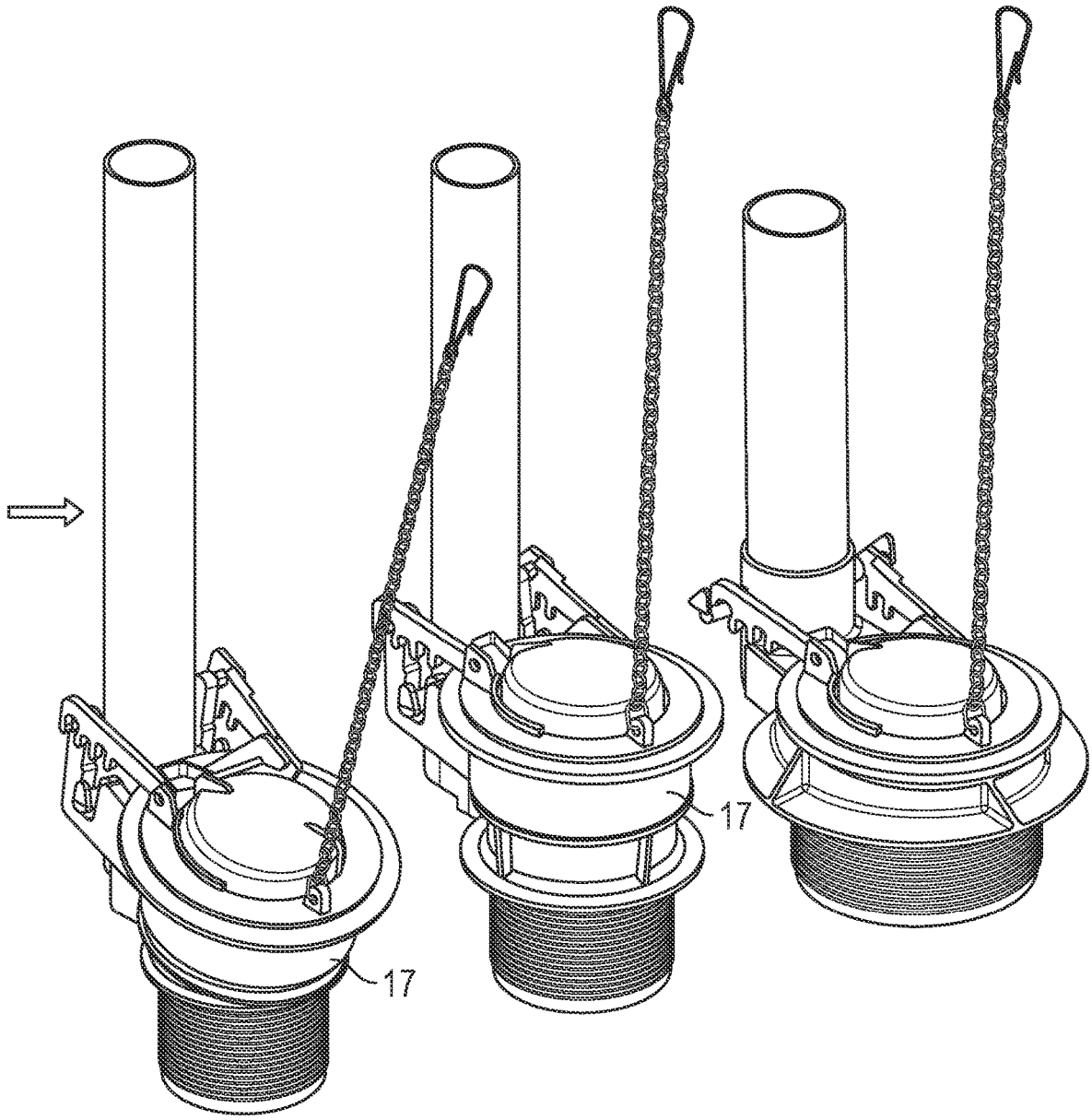
Figure 29:
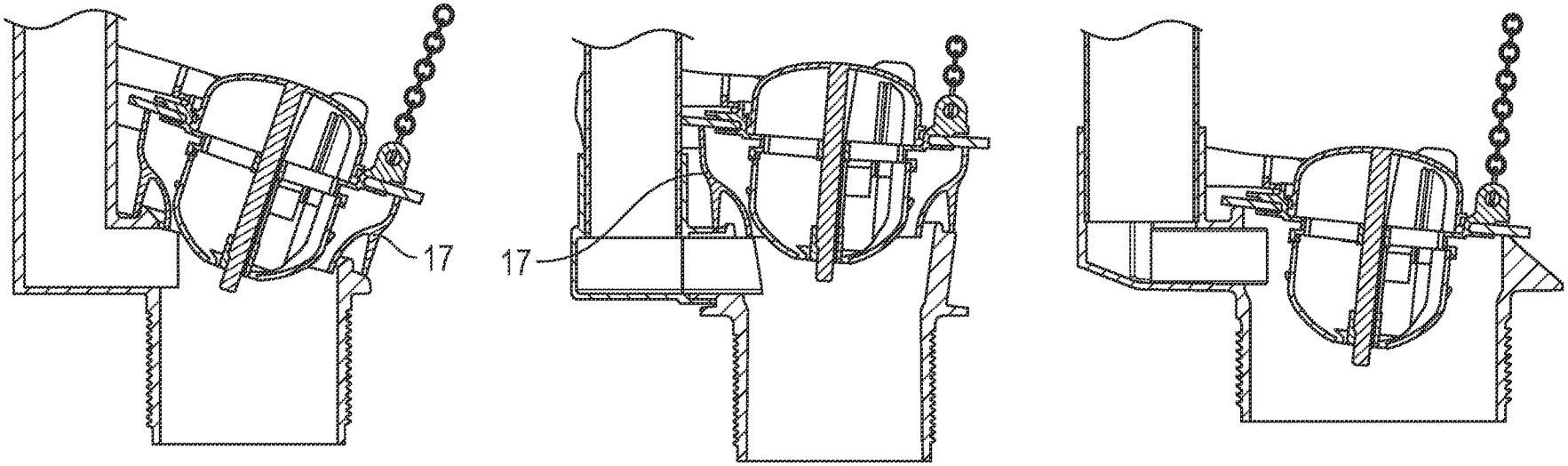
FIG. 29 illustrates a side sectional view of the first adaptor option installed on the three different types of valves according to some embodiments.
Figure 30:
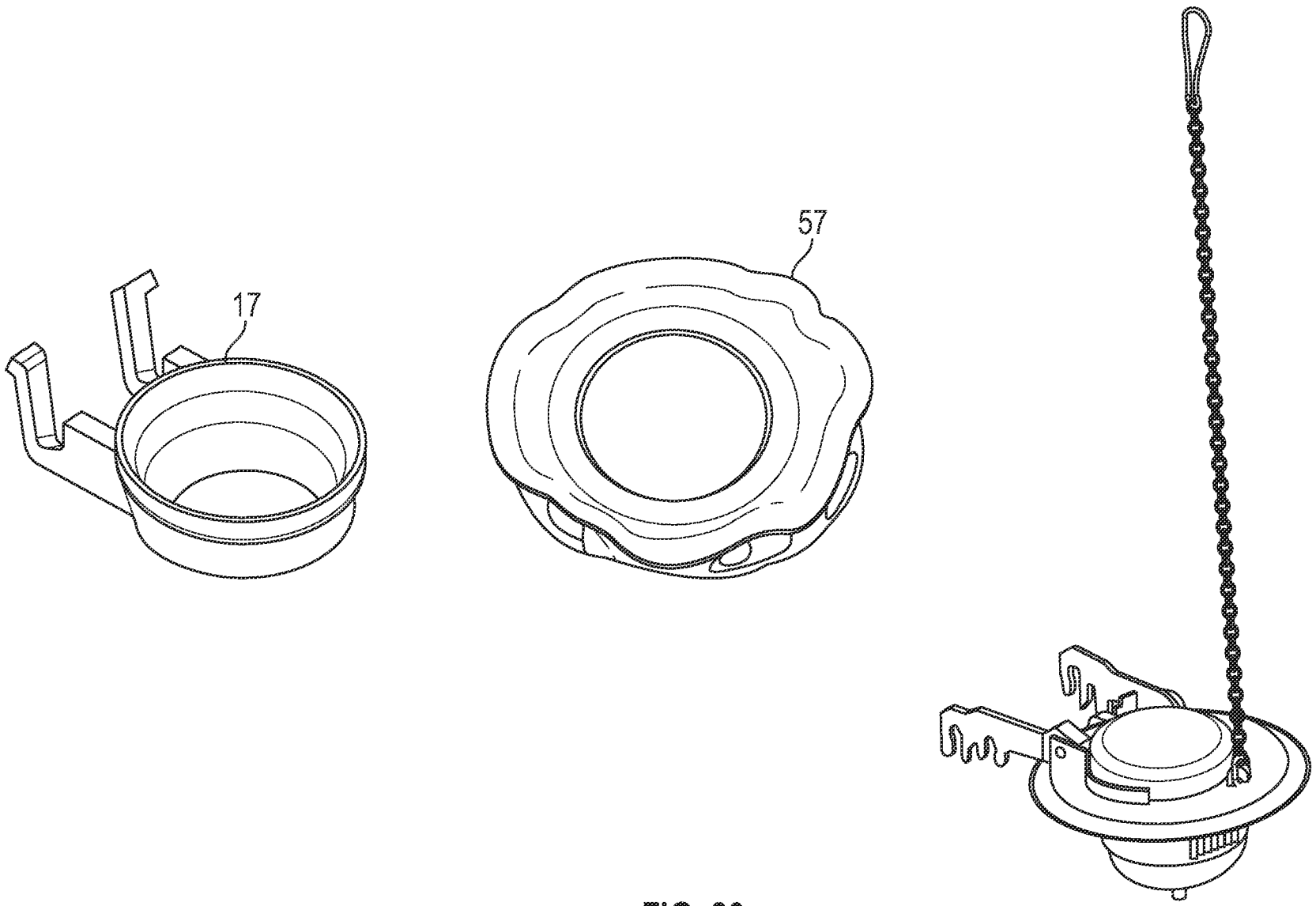
FIG. 30 depicts a method for converting the combination flapper system between 2" and 3" flush valve configuration according to some embodiments.
Figure 31:
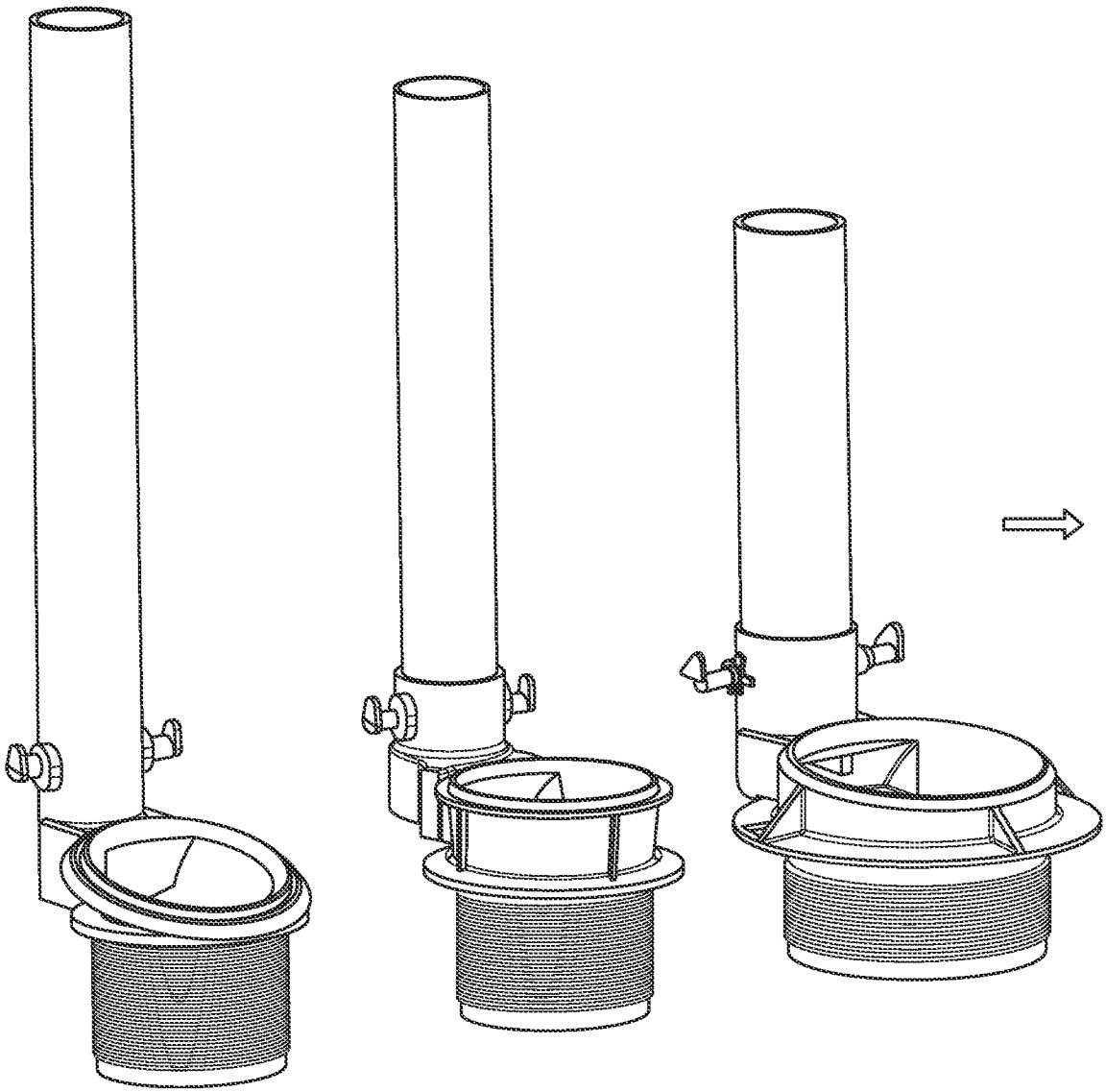
FIG. 31 illustrates a second option for installing the combination flapper system on the three different types of valves according to some embodiments.
Figure 31:
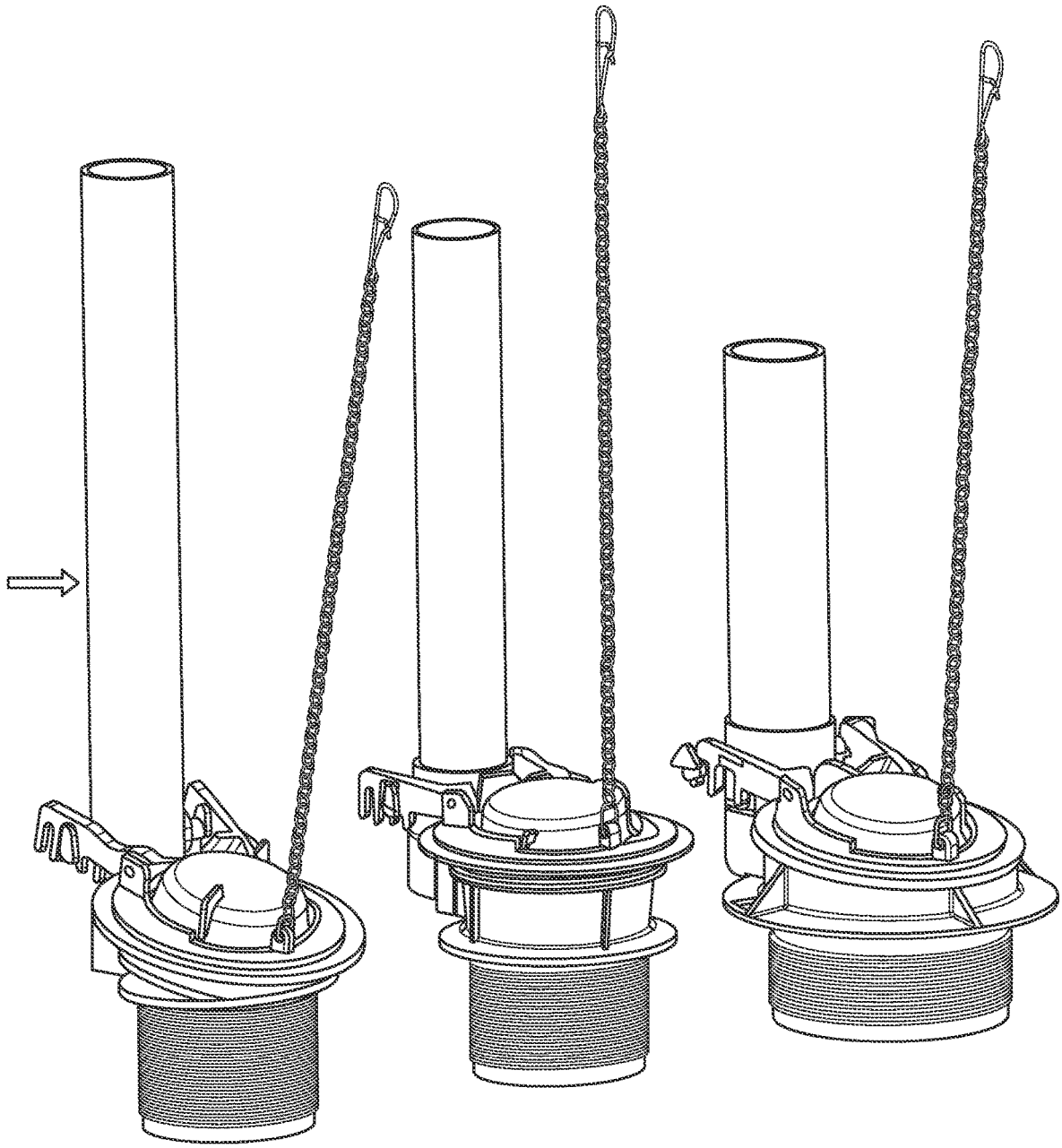

FIG. 25 illustrates the various cistern configurations a consumer may encounter according to some embodiments. FIG. 26 shows non-limiting examples of flapper types that can be replaced with the combination flapper system according to some embodiments. FIG. 27 illustrates, from left to right, a 2" angled seat valve, a 2" seat valve, and a 3" valve that are compatible with the flapper system according to some embodiments. FIG. 28 shows a first option for installing the flapper system on the three different types of valves using a system adaptor 17 according to some embodiments. FIG. 29 illustrates a side sectional view of the adaptor 17 option installed on the three different types of valves according to some embodiments. FIG. 30 depicts a method for converting the combination flapper system between 2" and 3" flush valve configuration using an adaptor 17 according to some embodiments. FIG. 31 illustrates a second option for installing the combination flapper system on the three different types of valves according that includes two lower buoyancy cups and two seals according to some embodiments.

Figure 32:
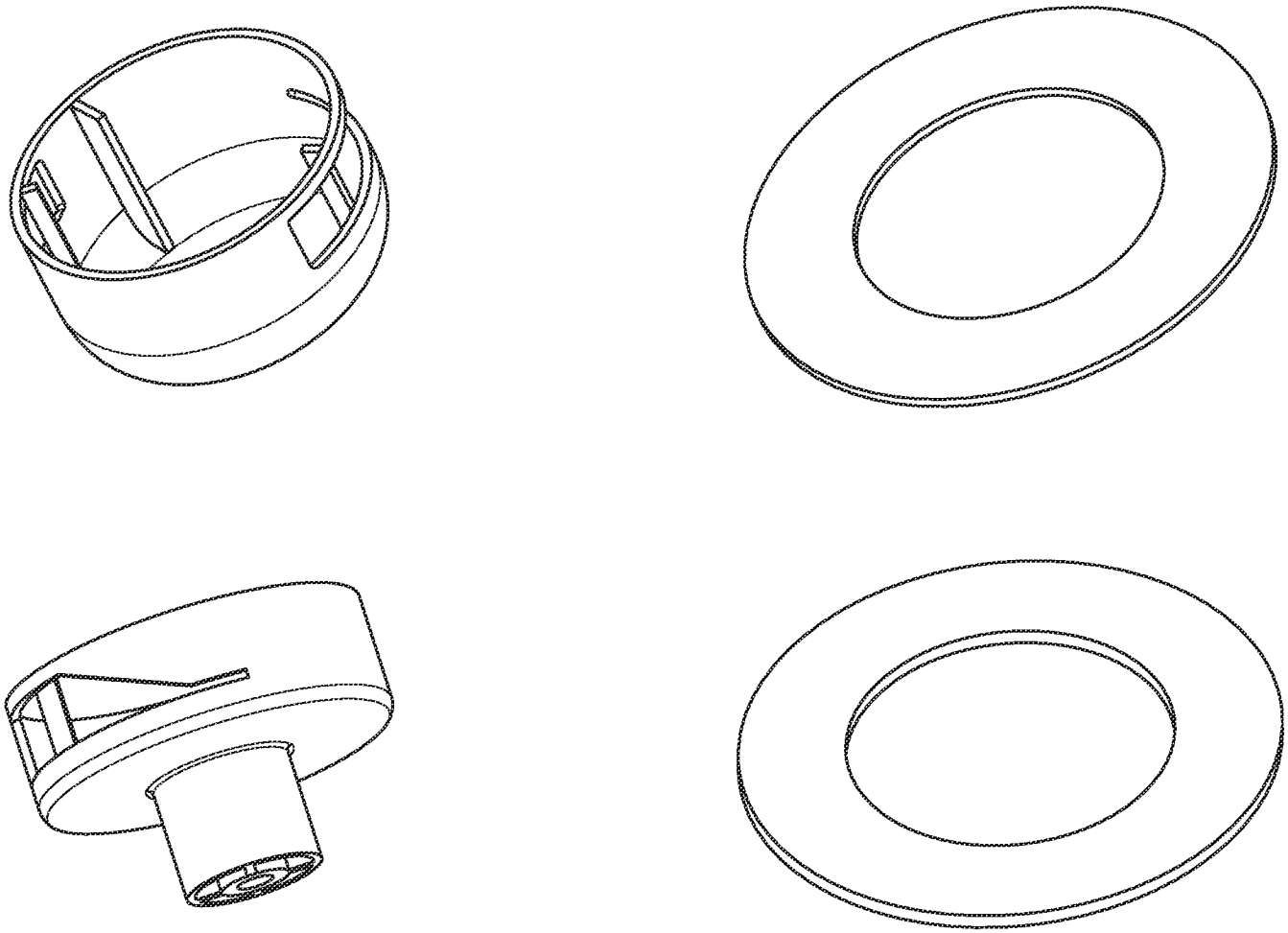
FIG. 32 illustrates exchanging seals and buoyancy cups to arrive at different flush valve configurations according to some embodiments.
Figure 32:
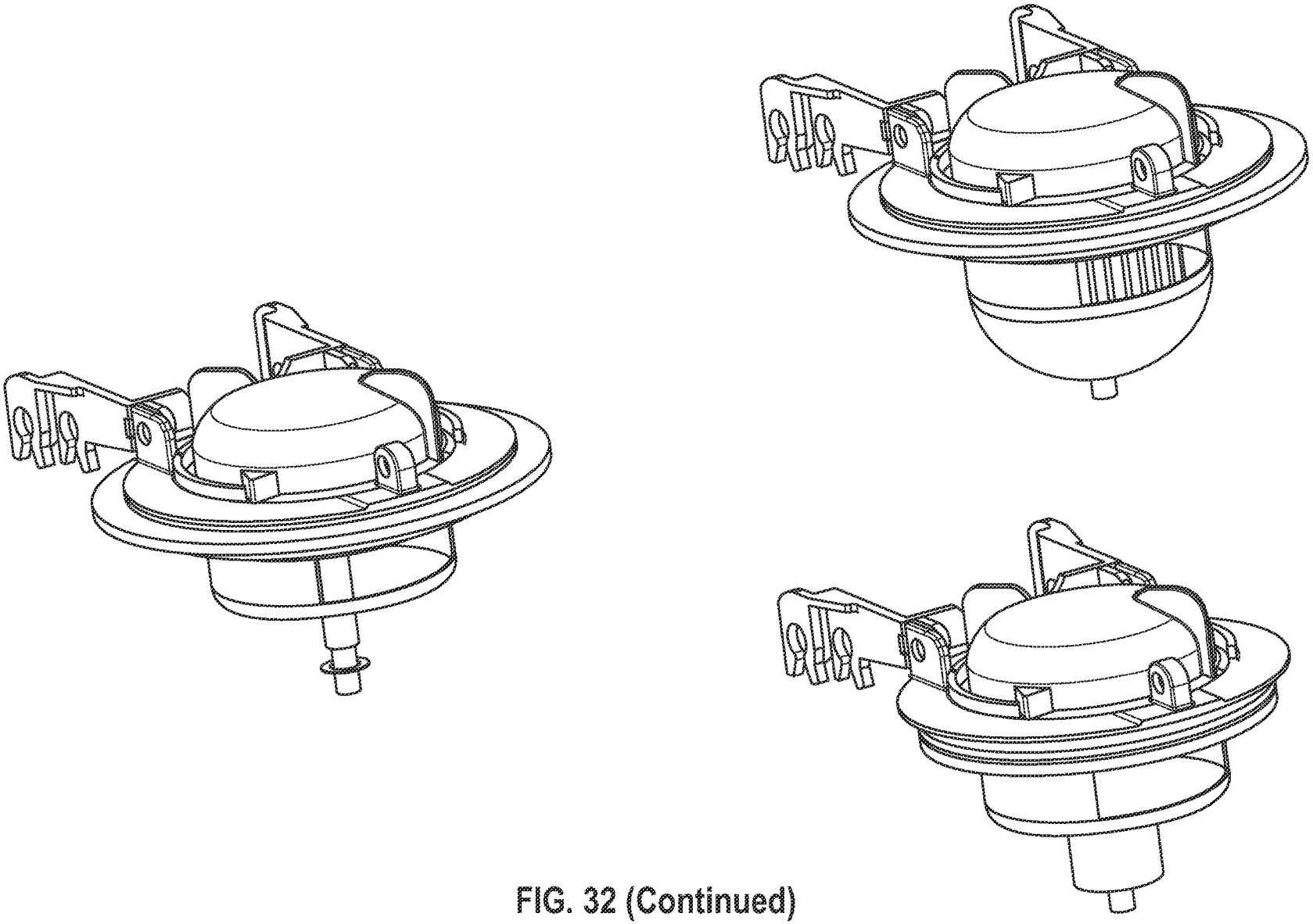

FIG. 32 illustrates exchanging seals and buoyancy cups to arrive at different flush valve configurations according to some embodiments. In some embodiments, the lower large buoyancy dome 3 is configured to be coupled (e.g., bayoneted) to the lower small buoyancy dome 4. In some embodiments, the coupling enables both of the domes to be rotated together.

Figure 33:
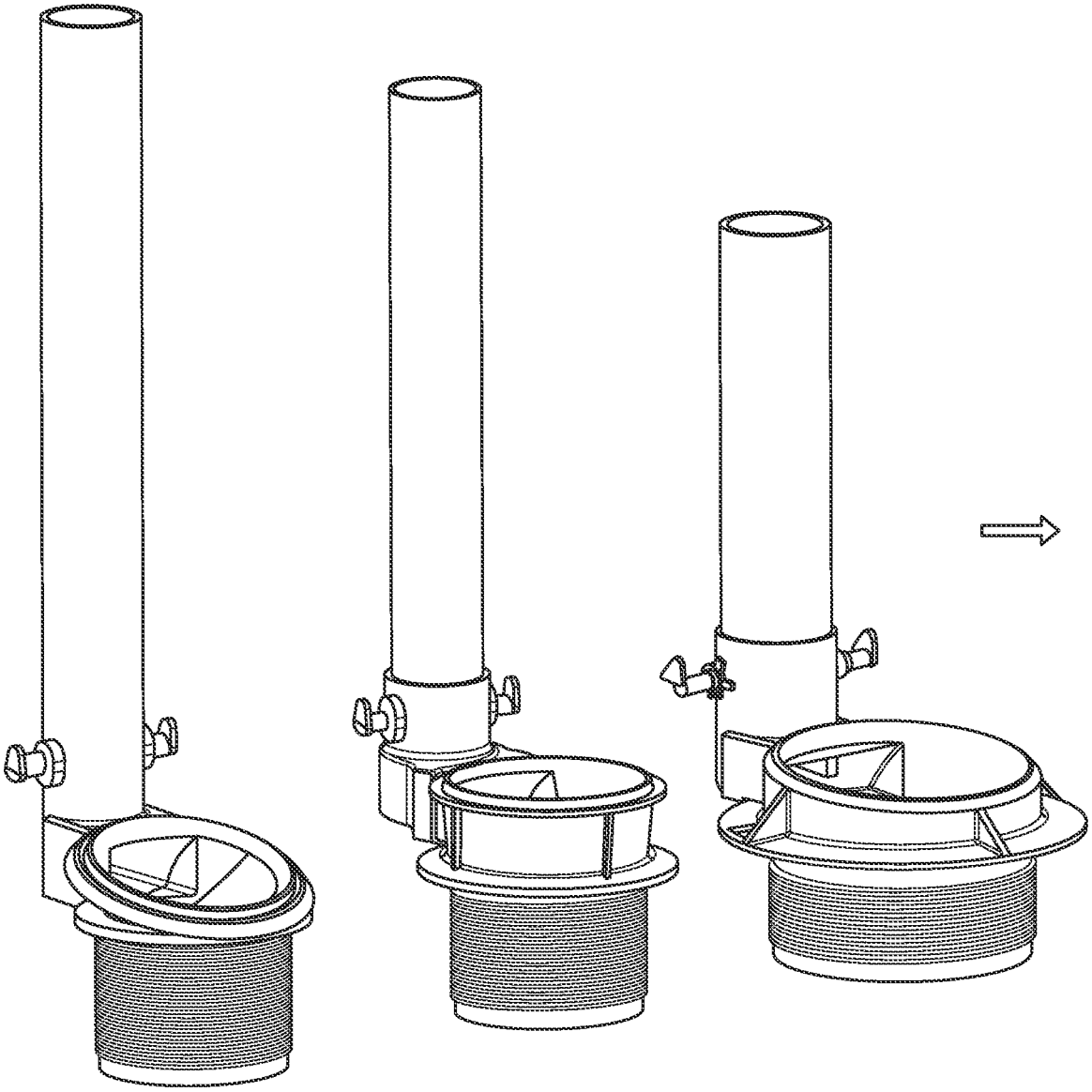
FIG. 33 shows a third option for a flapper system kit including proving the kit as fully assembled according to some embodiments.
Figure 33:
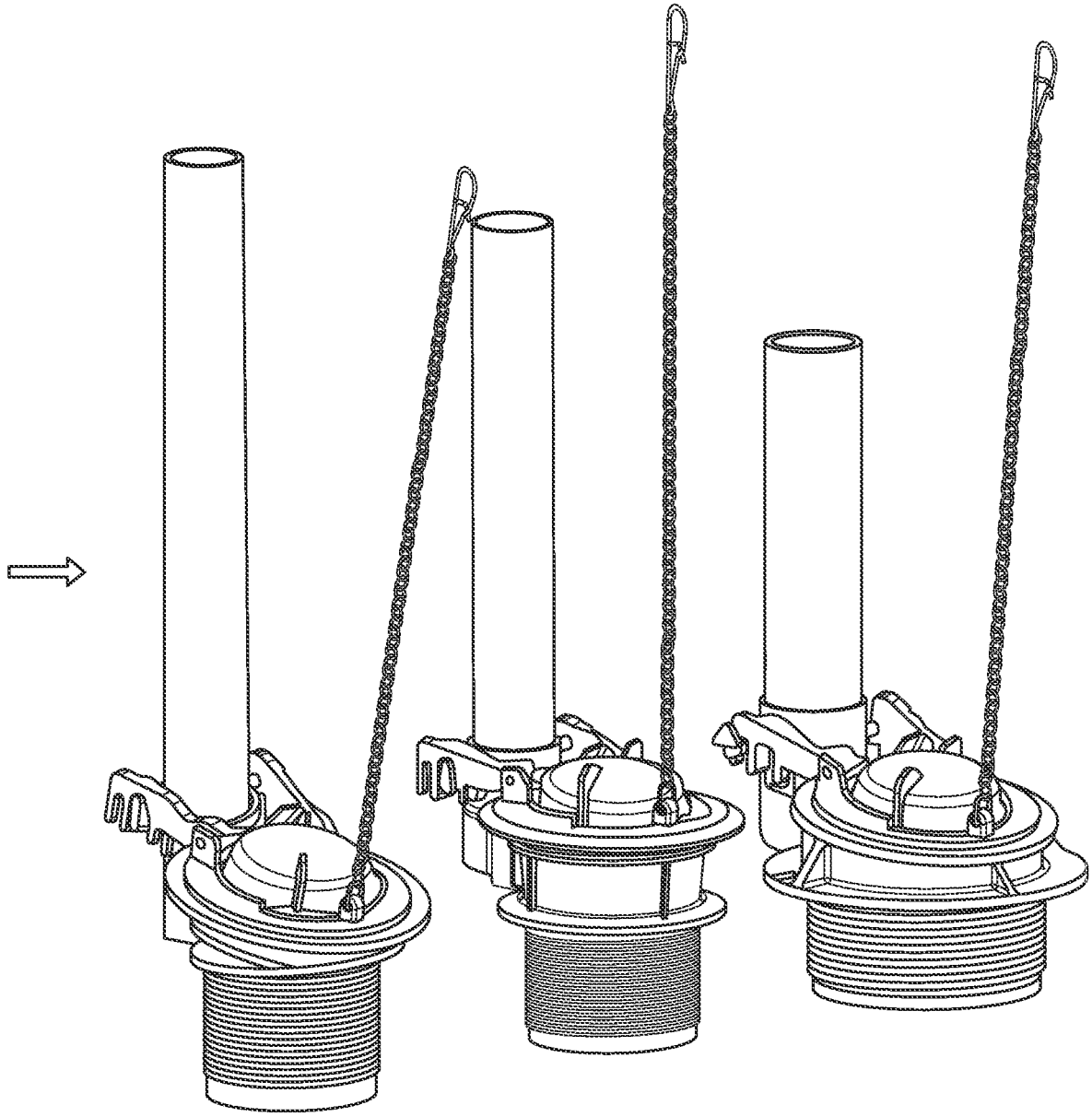

FIG. 33 shows a third option for a flapper system kit including proving the kit as fully assembled according to some embodiments. In some embodiments, the flapper system is configured to be ready for installation on a flush valve when fully assembled. In some embodiments, when an user replaces an old flapper with the flapper system on a 3" flush valve, the system is configured to enable a user to directly install a flapper to the flush seat by mounting the second pair of fulcrums to the two mounting ears on the flush seat.

Figure 34:
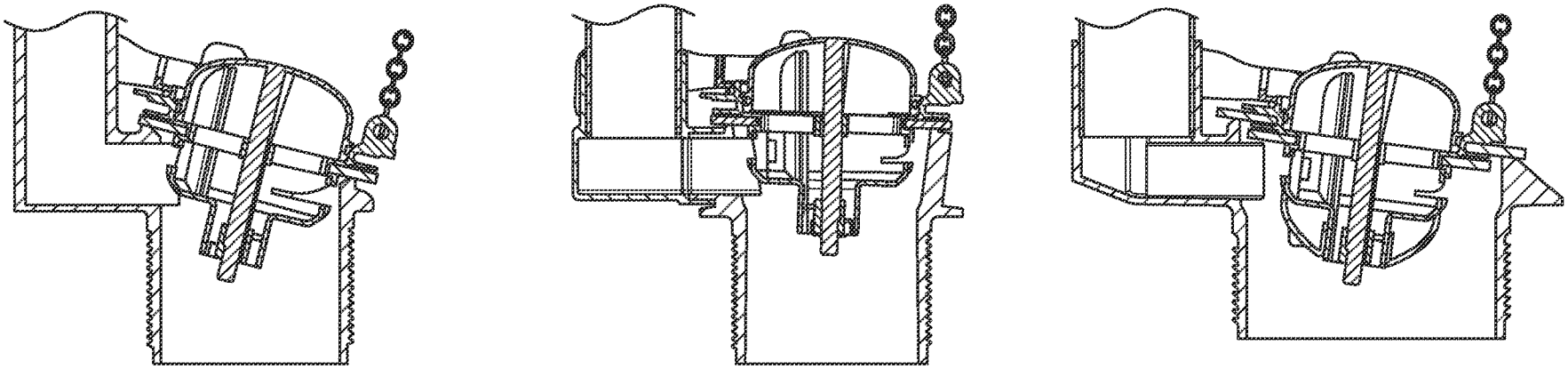
FIG. 34 depicts the third option fitting into the multiple sized flush valves according to some embodiments.
Figure 35:
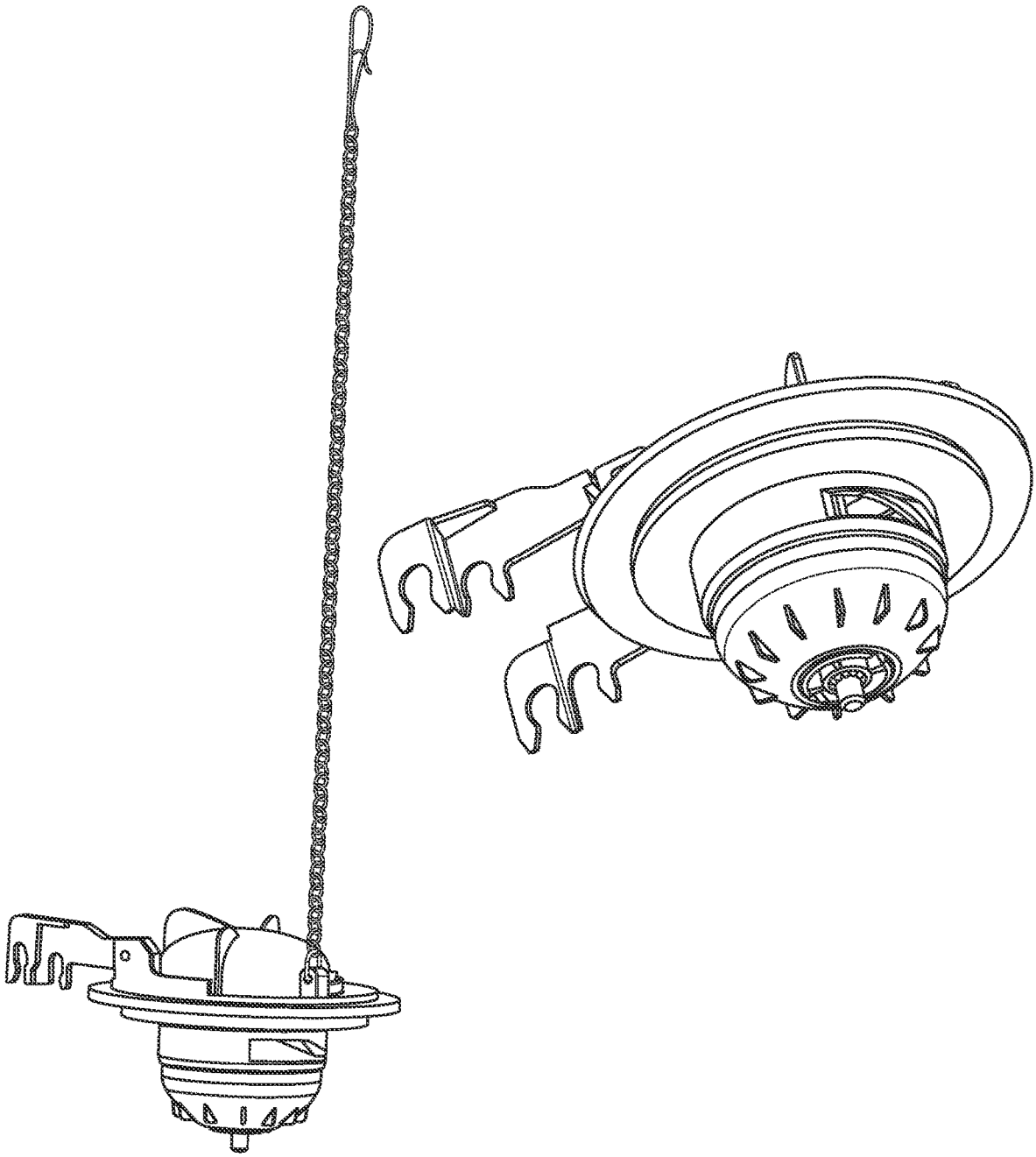
FIG. 35 shows providing one combination flapper with two different buoyancy cups and two different seals fully assembled as well as instructions for configuration according to some embodiments.
Figure 35:
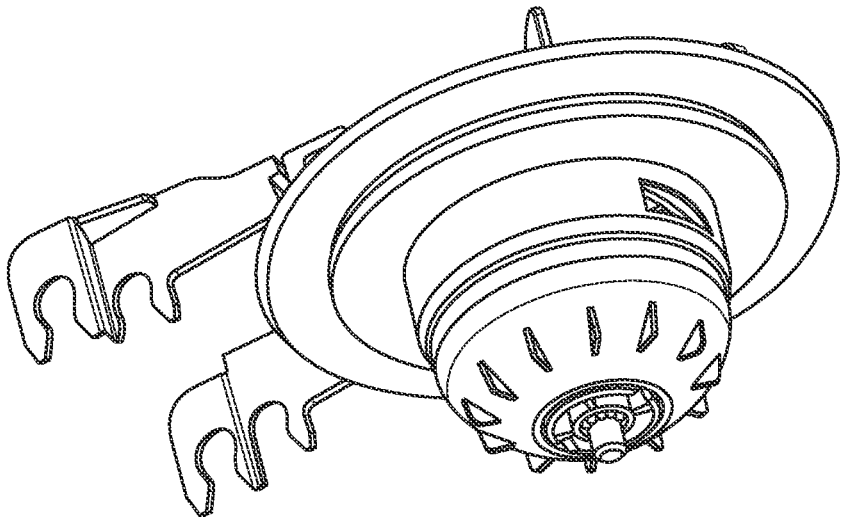
Figure 35:
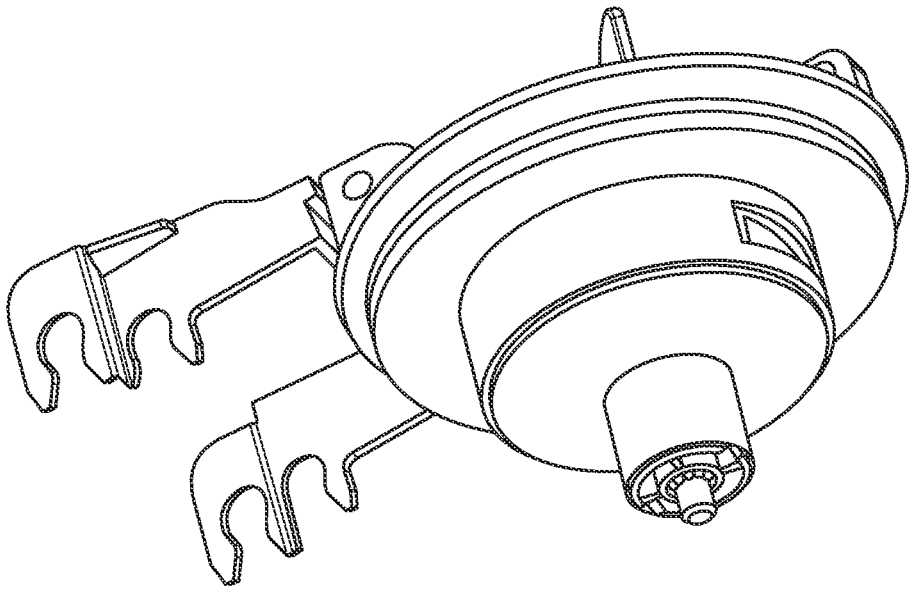

FIG. 34 depicts the third option fitting into the multiple sized flush valves without an adaptor according to some embodiments. FIG. 35 shows providing one combination flapper with two different buoyancy cups and two different seals fully assembled according to some embodiments. In some embodiments, when the system is installed on a 2" flush valve, the system is configured to enable a user to install the system by performing one or more of the steps that include: peel off the large seal 5 from the flapper main body; couple the lower large buoyancy dome 3 to the lower small buoyancy dome 4; and mount fulcrums to the two mounting ears 16 of a 2" flush seat.

Figure 36:
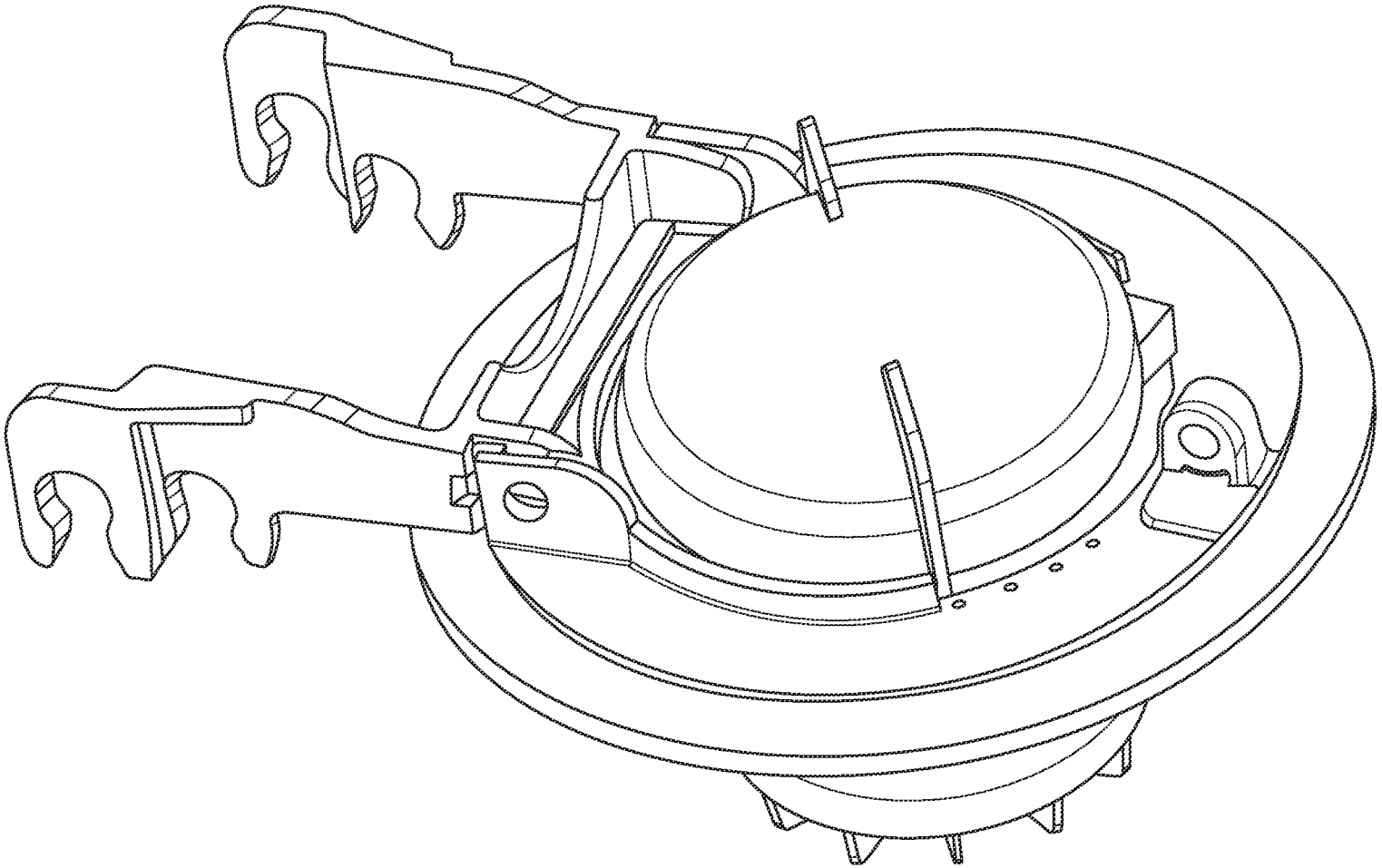
FIG. 36 illustrates adjustments for the flapper system according to some embodiments.
Figure 37:
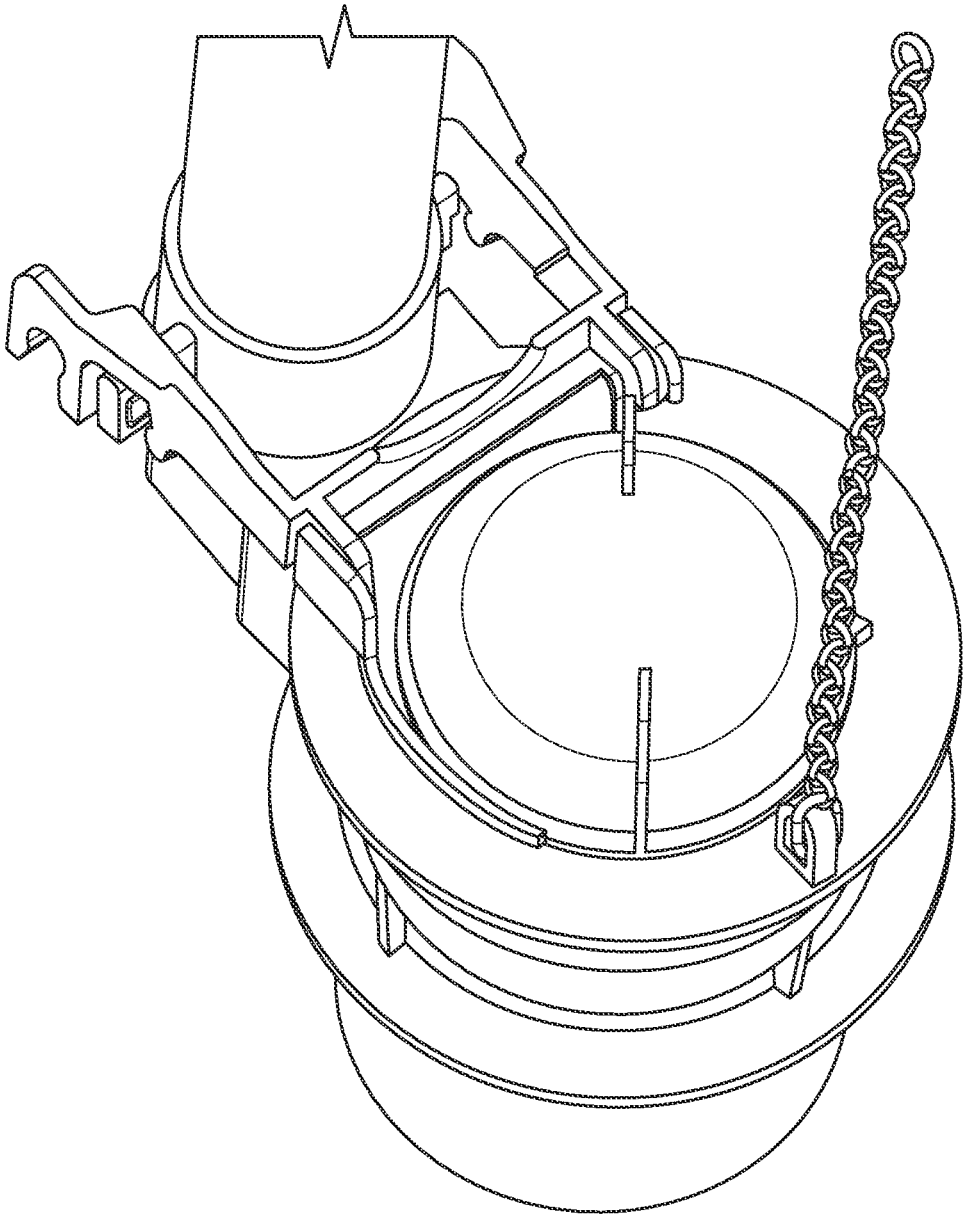
FIG. 37 depicts a fully assembled combination flapper system according to some embodiments.

FIG. 36 illustrates another view of the flapper system according to some embodiments. FIG. 37 depicts a fully assembled combination flapper system according to some embodiments. In some embodiments, when assembled the upper buoyancy dome 2 is configured to be rotated (e.g., clockwise and counter-clockwise) to adjust the size of the windows 11,12 to adjust the buoyance by adjusting the residual water levels in a buoyancy dome resulting in a change in time before the flapper lowers and seals the flush valve. In some embodiments, when the upper buoyancy dome 2 is rotated, it will open or close one or more of the air bleeding (window 12) and water bleed 11 paths. In some embodiments, both the air bleeding paths and water bleeding paths are provided by the adjustable windows 12. In some embodiments, the larger the air bleeding path, the sooner the flapper closes and vice versa. In some embodiments, the system is intuitive for during installation and therefore does not require complicated instructions.

In some embodiments, the system includes one or more conversion seals. In some embodiments, the one or more conversion seals includes an adaptor 17 (see FIGS. 28-30) and/or a sealant ring 57 configured to convert a 2" flush valve seat into a 3" flush valve seat. In some embodiments, the conversion seal comprises a valve seat bottom configured to seal against a 2" flush valve seat. In some embodiments, the conversion seal comprises a 3" flapper seat top configured to seal against a 3" flapper, such as one described herein. In some embodiments, the adaptor 17 is included as part of the kit.

The subject matter described herein are directed to technological improvements to the field of flush valve flapper replacement by providing a single system that can replace the flappers for different flush valve seat types. Indeed, the systems and methods described herein were unknown and/or not present in the public domain at the time of filing, and they provide a technologic improvements advantages not known in the prior art. Furthermore, the system includes unconventional steps that confine the methods described herein to a useful application.

It is understood that the system is not limited in its application to the details of construction and the arrangement of components set forth in the previous description or illustrated in the drawings. The system and methods disclosed herein fall within the scope of numerous embodiments. The previous discussion is presented to enable a person skilled in the art to make and use some embodiments of the system. Any portion of the structures and/or principles included in some embodiments can be applied to any and/or all embodiments: it is understood that features from some embodiments presented herein are combinable with other features from some other embodiments. As a non-limiting example, the upper buoyancy dome 2 in FIG. 2 can be replaced with the adjustable upper dome 51 in FIG. 24 and still fall within the disclosure according to some embodiments. Thus, some embodiments of the system are not intended to be limited to what is illustrated but are to be accorded the widest scope consistent with all principles and features disclosed herein, where the term "in some embodiments" or "according to some embodiments" as used herein means features from one figure or section of the disclosure are readily incorporable with features from another figure or section of the disclosure.

Some embodiments of the system are presented with specific values and/or setpoints. These values and setpoints are not intended to be limiting and are merely examples of a higher configuration versus a lower configuration and are intended as an aid for those of ordinary skill to make and use the system. For example, reference to a 2" valve and a 3" valve seat can be replaced with more general language such as "first" and "second" valve seat when defining the metes and bounds of the system.

Furthermore, acting as Applicant's own lexicographer, Applicant imparts the explicit meaning and/or disavow of claim scope to the following terms:

Applicant defines any use of "and/or" such as, for example, "A and/or B," or "at least one of A and/or B" to mean element A alone, element B alone, or elements A and B together. In addition, a recitation of "at least one of A, B, and C," a recitation of "at least one of A, B, or C," or a recitation of "at least one of A, B, or C or any thereof" are each defined to mean element A alone, element B alone, element C alone, or any of elements A, B and C, such as AB, AC, BC, or ABC, for example.

"Substantially" and "approximately" when used in conjunction with a value encompass a difference of 5% or less of the same unit and/or scale of that being measured.

As used herein, "can" or "may" or derivations there of (e.g., the system can perform X) are used for descriptive purposes only and is understood to be synonymous and/or interchangeable with "configured to" (e.g., the flapper is configured to perform X) when defining the metes and bounds of the system.

In addition, the term "configured to" means that the limitations recited in the specification and/or the claims must be arranged in such a way to perform the recited function: "configured to" excludes structures in the art that are "capable of" being modified to perform the recited function but the disclosures associated with the art have no explicit teachings to do so. For example, a recitation of a "container configured to receive a fluid from structure X at an upper portion and deliver fluid from a lower portion to structure Y" is limited to systems where structure X, structure Y, and the container are all disclosed as arranged to perform the recited function. The recitation "configured to" excludes elements that may be "capable of" performing the recited function simply by virtue of their construction but associated disclosures (or lack thereof) provide no teachings to make such a modification to meet the functional limitations between all structures recited. The recitation "configured to" can also be interpreted as synonymous with "operatively connected" when used in conjunction with physical structures.

It is understood that the phraseology and terminology used herein is for description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

The previous detailed description is to be read with reference to the figures, in which like elements in different figures have like reference numerals. The figures, which are not necessarily to scale, depict some embodiments and are not intended to limit the scope of embodiments of the system. It is understood that the drawings are part of the disclosure and that words and phrases used to describe the drawings when defining the metes and bounds of the system do not need verbatim support in the specification so long as the language is supported by the drawings.

Although method operations are presented in a specific order according to some embodiments, the execution of those steps do not necessarily occur in the order listed unless a explicitly specified.

It will be appreciated by those skilled in the art that while the invention has been described above in connection with particular embodiments and examples, the invention is not necessarily so limited, and that numerous other embodiments, examples, uses, modifications and departures from the embodiments, examples and uses are intended to be encompassed by the claims attached hereto. The entire disclosure of each patent and publication cited herein is incorporated by reference, as if each such patent or publication were individually incorporated by reference herein. Various features and advantages of the invention are set forth in the following claims.

We claim:

1. A flapper system comprising:
a flapper main body,
an upper buoyancy dome,
a first lower buoyancy dome, and
one or more mounting arms;
wherein the flapper main body comprises a main body window configured to enable water to pass therethrough.

2. The flapper system of claim 1,
wherein the first lower buoyancy dome comprises a lower dome window configured to enable water to pass therethrough.

3. The flapper system of claim 2,
wherein the main body window and the lower dome window cooperate with each other to adjust a flowrate of water through both windows.

4. The flapper system of claim 3,
wherein the upper buoyancy dome is configured rotate; and
wherein a rotation of the upper buoyancy dome adjusts the flowrate of water through both windows.

5. A flapper system comprising:
a flapper main body,
an upper buoyancy dome,
a first lower buoyancy dome, and
one or more mounting arms;
wherein the flapper main body is configured to be coupled between the upper buoyancy dome and the first lower buoyancy dome when the flapper system is assembled;
wherein the flapper main body comprises a first groove and a second groove;
wherein the first groove is configured to secure a 2 inch flush valve seal to the flapper main body; and
wherein the second groove is configured to secure a 3 inch flush valve seal to the flapper main body.

6. A flapper system comprising:
a flapper main body,
an upper buoyancy dome,
a first lower buoyancy dome, and
one or more mounting arms;
wherein the flapper main body comprises a first groove and a second groove;
wherein the first groove is configured to secure a first flush valve seal to the flapper main body;
wherein the second groove is configured to secure a second flush valve seal to the flapper main body; and
wherein the first flush valve seal is a different size than the second flush valve seal.

7. A flapper system comprising:
a flapper main body,
an upper buoyancy dome,
a first lower buoyancy dome, and
one or more mounting arms;
wherein each of the one or more mounting arms comprise at first fulcrum and a second fulcrum;
wherein the first fulcrum is configured to align a first flush valve seal with a 2 inch flush valve seat to prevent a flow of water out of a cistern.

8. The flapper system of claim 7,
wherein the second fulcrum is configured to align a second flush valve seal with a 3 inch flush valve seat to prevent the flow of water out of a cistern.

9. The flapper system of claim 7,
wherein the one or more mounting arms are pivotally mounted to the flapper main body on a pivot.

10. The flapper system of claim 9,
wherein the pivot is configured to enable the flapper system to seal either a flat valve or an angled valve seat.

11. A flapper system comprising:
a flapper main body,
an upper buoyancy dome,
a first lower buoyancy dome,
a second lower buoyancy dome, and
one or more mounting arms.

12. The flapper system of claim 11,
wherein the second lower buoyancy dome is configured to increase a buoyancy of the flapper system greater than the first lower buoyancy dome.

13. The flapper system of claim 11,
wherein the second lower buoyancy dome is configured to couple to one or more of the upper buoyancy dome, the flapper main body, and the first lower buoyancy dome.

14. A flapper system comprising:
a flapper main body,
a first fulcrum, and
a second fulcrum;
wherein the first fulcrum is configured to align the flapper main body with a 2 inch flush valve seat when connected to a 2 inch flush valve;
wherein the second fulcrum is configured to align the flapper main body with a 3 inch flush valve seat when connected to a 3 inch flush valve;
wherein the first fulcrum is configured to separably couple to the flapper main body; and
wherein the second fulcrum is configured to separably couple to the first fulcrum.

15. The flapper system of claim 14,
wherein the flapper main body comprises an upper buoyancy dome;
wherein the upper buoyancy dome comprises a link fastener; and
wherein the link fastener is located at one or more of a front, a rear, a center, a left side, and a right side of the upper buoyancy dome.

16. The flapper system of claim 15,
further comprising a first lower buoyancy dome;
wherein the upper buoyancy dome comprises a protrusion rod;
wherein the flapper main body comprises an open portion configured to enable the protrusion rod to pass therethrough; and wherein the first lower buoyancy dome is configured to couple to the upper buoyancy dome via the protrusion rod.

17. The flapper system of claim 16, wherein the flapper main body is configured to be coupled between the upper buoyancy dome and the first lower buoyancy dome when the flapper system is assembled.

* * * * *